US009204738B2

(12) United States Patent
Sitton

(10) Patent No.: US 9,204,738 B2
(45) Date of Patent: Dec. 8, 2015

(54) MODULAR FOLDING STAND

(76) Inventor: Oren Sitton, Nes-Ziona (IL)

( * ) Notice: Subject to any disclaimer, the term of this patent is extended or adjusted under 35 U.S.C. 154(b) by 0 days.

(21) Appl. No.: 13/555,185

(22) Filed: Jul. 22, 2012

(65) Prior Publication Data

US 2013/0098909 A1 Apr. 25, 2013

(51) Int. Cl.

| | |
|---|---|
| ***A47F 5/10*** | (2006.01) |
| ***A47F 5/11*** | (2006.01) |
| ***A47F 5/12*** | (2006.01) |
| *A47B 43/02* | (2006.01) |

(52) U.S. Cl.

CPC ..... *A47F 5/118* (2013.01); *A47B 43/02* (2013.01); *A47F 5/116* (2013.01)

(58) Field of Classification Search

CPC ..... A47B 43/02; A47F 5/11; A47F 5/112; A47F 5/114; A47F 5/118

USPC ..... 211/71.01, 72, 73, 132.1, 135, 149, 211/189; 206/736, 740, 744, 745, 767; 108/99, 101, 180, 193; 220/4.28, 4.29, 220/689, 690; 312/257.1, 263, 265.5

See application file for complete search history.

(56) References Cited

U.S. PATENT DOCUMENTS

| | | | | | |
|---|---|---|---|---|---|
| 1,559,878 | A * | 11/1925 | Humphreys | ..... | 312/262 |
| 3,576,355 | A * | 4/1971 | Stone et al. | ..... | 312/258 |
| 3,591,245 | A * | 7/1971 | Allen | ..... | 312/258 |
| 3,863,575 | A * | 2/1975 | Kuns et al. | ..... | 108/179 |
| 4,322,005 | A * | 3/1982 | Robertson | ..... | 211/59.4 |
| 4,506,790 | A * | 3/1985 | Muscari | ..... | 211/59.4 |
| 7,014,267 | B1 * | 3/2006 | Nagar | ..... | 297/440.14 |
| 7,500,574 | B1 * | 3/2009 | Miller et al. | ..... | 211/106 |
| 8,651,296 | B2 * | 2/2014 | Beaty | ..... | 211/135 |
| 8,651,297 | B2 * | 2/2014 | Beaty | ..... | 211/135 |
| 8,651,298 | B2 * | 2/2014 | Beaty | ..... | 211/135 |
| 2006/0118502 | A1 * | 6/2006 | Polvere et al. | ..... | 211/135 |

FOREIGN PATENT DOCUMENTS

| | | | | | |
|---|---|---|---|---|---|
| FR | 917999 | * | 1/1947 | ..... | A47F 5/112 |
| GB | 2343688 A | * | 5/2000 | ..... | A47B 47/06 |

* cited by examiner

*Primary Examiner* — Joshua Rodden

(74) *Attorney, Agent, or Firm* — Perel—Intellectual Property Law

(57) ABSTRACT

A folding apparatus for storing articles for display, the apparatus including a board of multiwall structure of polypropylene material which board includes two parallel vertical folds dividing a first sheet of the board into a back-plane part, a left side part and a right side part. The side parts are foldable by 180 degrees with respect to the back-plane part. The back-plane part includes a plurality of horizontal slots, and the side parts include a plurality of holes corresponding to the plurality of slots. The apparatus also includes a A plurality of rods which are insertable through corresponding holes in the side parts. The apparatus also includes a plurality of shelves also including multiwall structure of polypropylene material, where each shelf rests on one of the plurality of rods and has a flap inserted in a corresponding slot.

10 Claims, 21 Drawing Sheets

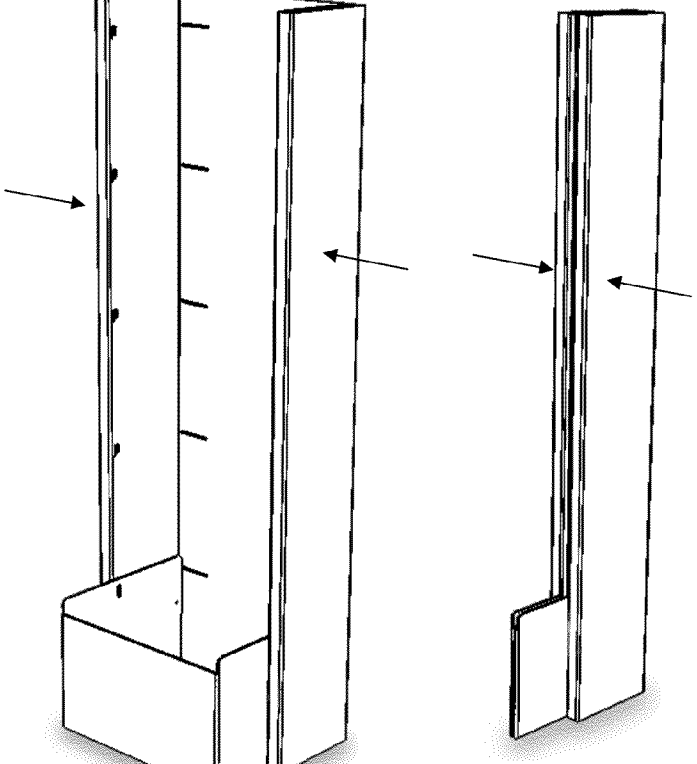
Fig. 16B
Fig. 16A
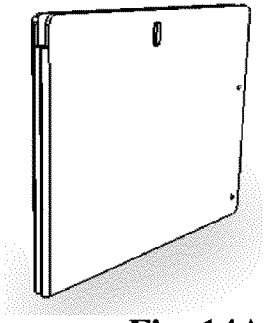
Fig. 14A
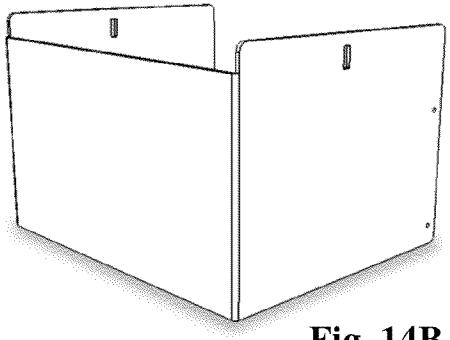
Fig. 14B
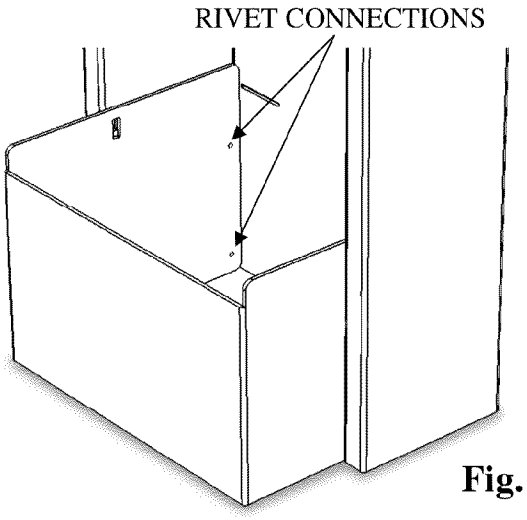
Fig. 15

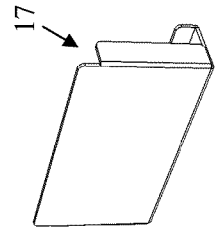
Fig. 20
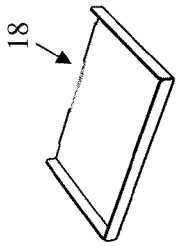
Fig. 21
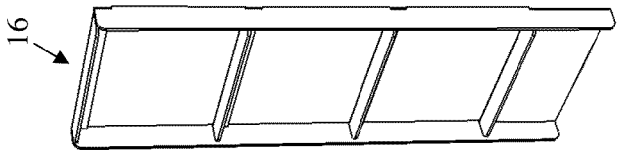
Fig. 19
Fig. 18B
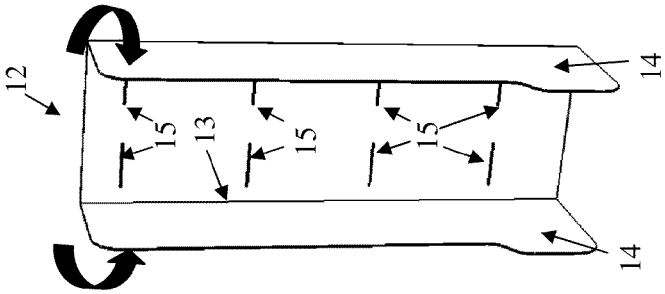
Fig. 18A
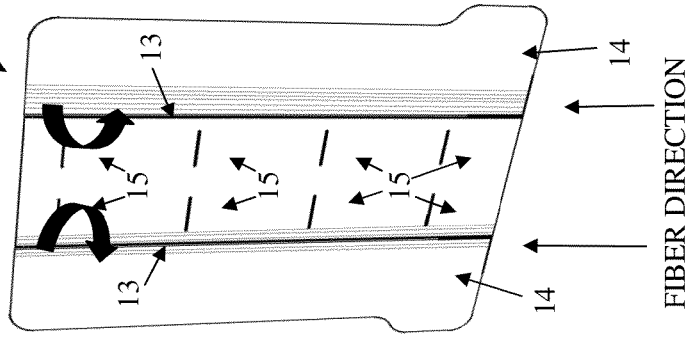

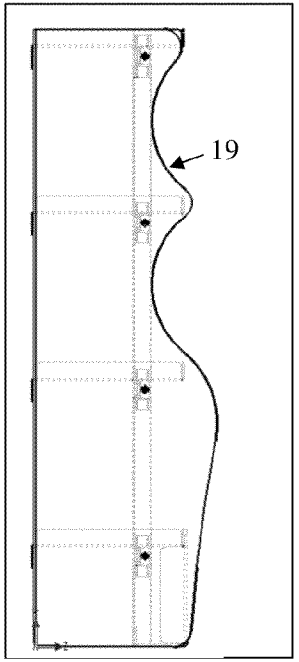
Fig. 23A
Fig. 23B
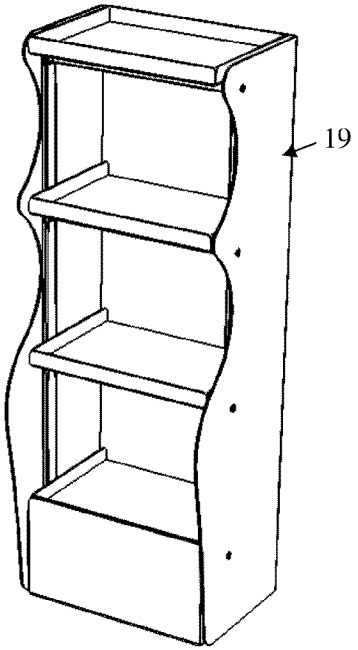
Fig. 23D
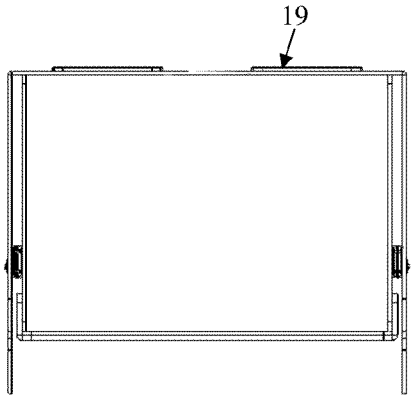
Fig. 23C

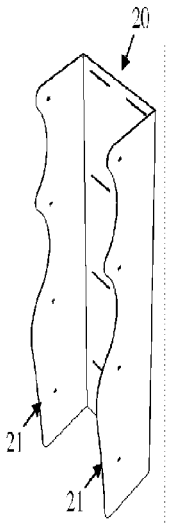
Fig. 24
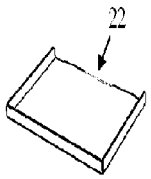
Fig. 25
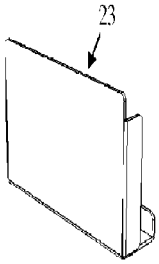
Fig. 26
Fig. 27B
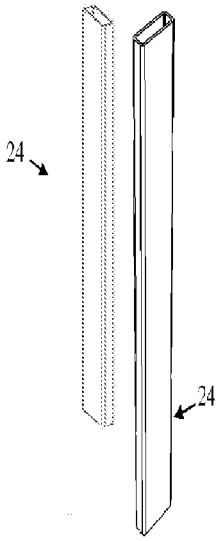
Fig. 27A
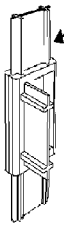
Fig. 28A
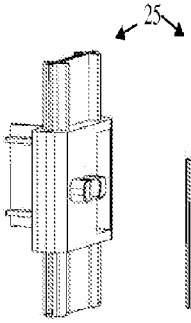
Fig. 28B
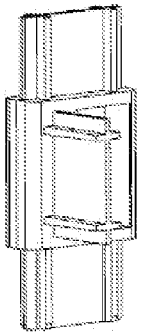
Fig. 28C

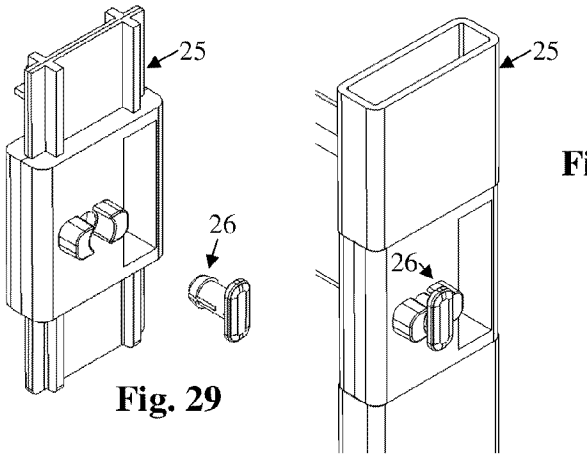
Fig. 30
Fig. 29
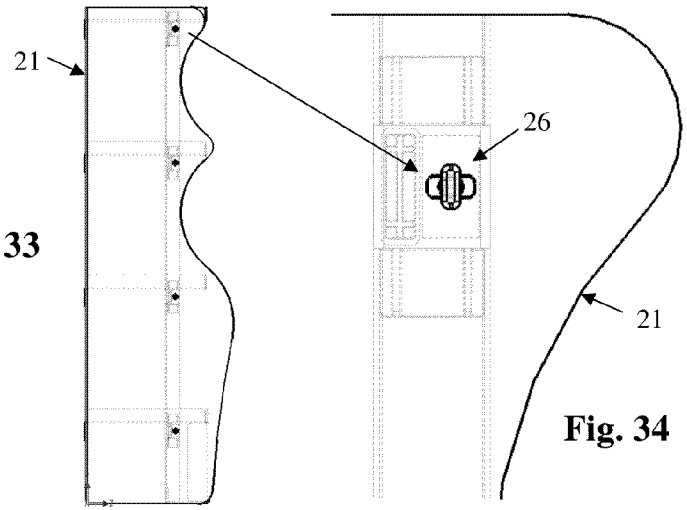
Fig. 33
Fig. 34
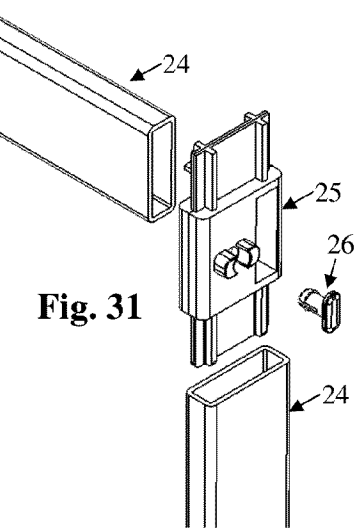
Fig. 31
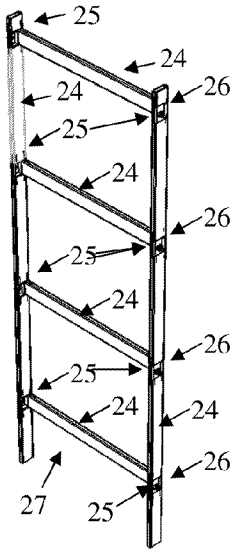
Fig. 32

Fig. 35A
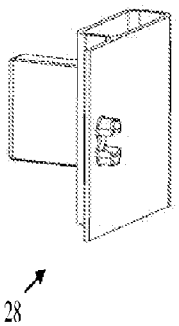
Fig. 35B
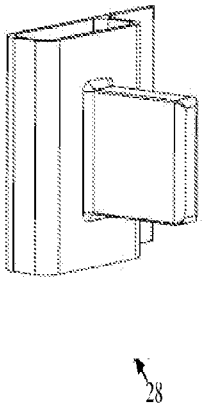
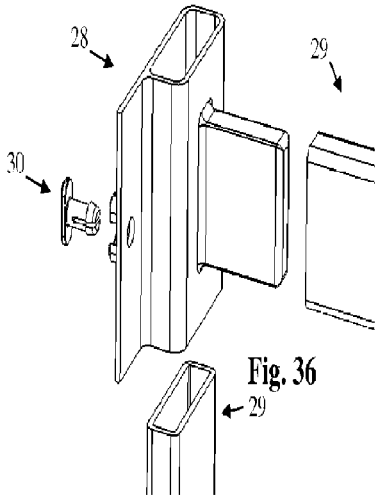
Fig. 36
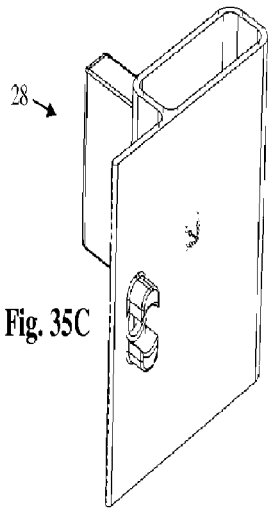
Fig. 35C
Fig. 37
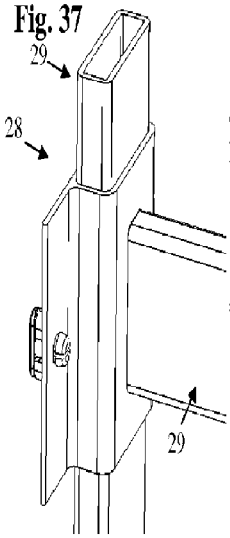
Fig. 38
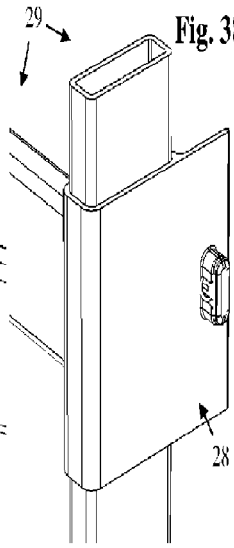

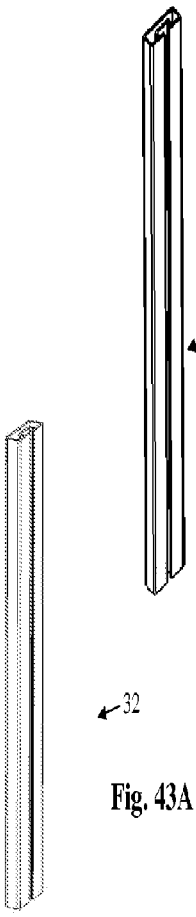
Fig. 43B
Fig. 43A
Fig. 44A
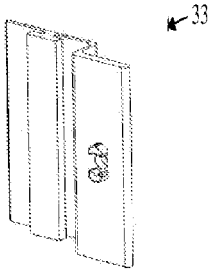
Fig. 44B
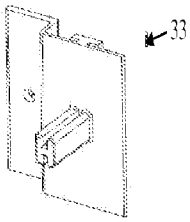
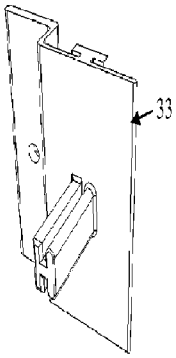
Fig. 44C

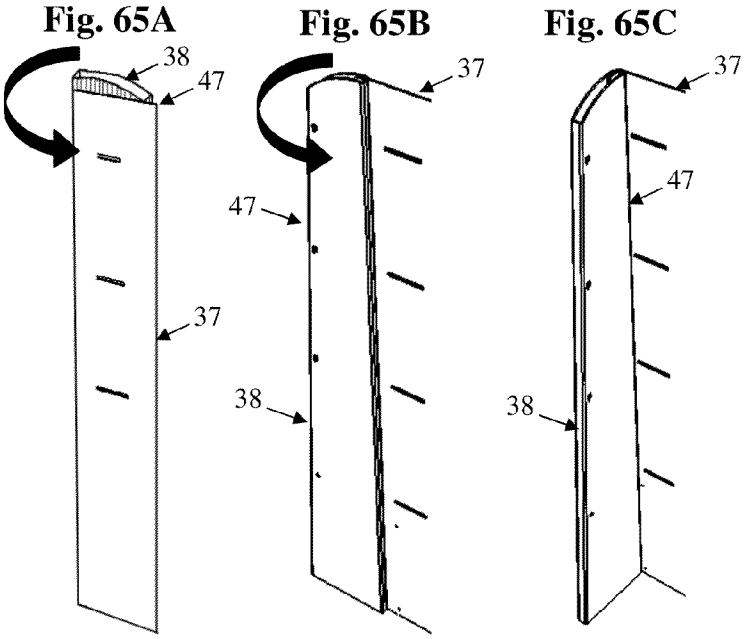
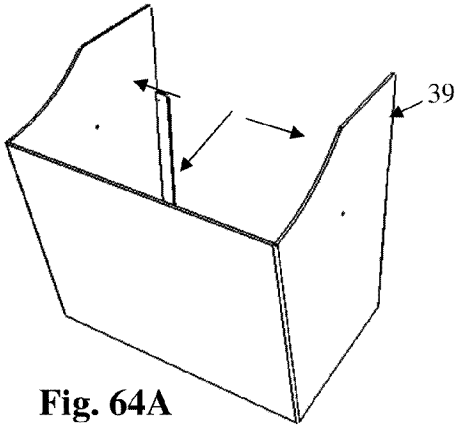
Fig. 64A
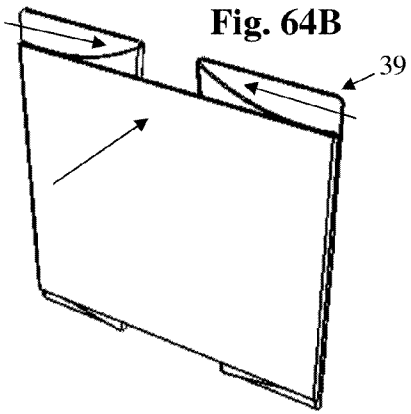
Fig. 64B

MODULAR FOLDING STAND

CROSS-REFERENCE TO RELATED APPLICATIONS

This is a non-provisional application for patent being filed in the United States Patent Office under 35 USC 111(*a*) and 37 CFR 1.53(*b*) and claiming the benefit of the prior filing date under 35 USC 119(*e*)(1) of the provisional application for patent filed with the United States Patent Office on Jul. 22, 2011, assigned Ser. No. 61/510,500 and bearing the title of Modular Folding Stand, and of the provisional application for patent filed with the United States Patent Office on Oct. 25, 2011, assigned Ser. No. 61/550,937 and bearing the title of Modular Folding Stand Full Beam and naming a common inventor. The contents of each of these provisional applications for patent are hereby incorporated by reference in their entirety.

FIELD OF THE INVENTION

The present invention relates to point of sale displays, or point of sale stands, and more particularly but not exclusively, to foldable constructions for presenting articles for sale.

BACKGROUND OF THE INVENTION

There is a widely recognized need for display systems, or stands, which are foldable to be comfortably carried around, easy to unfold and place in site, large and stable enough to carry a large number of articles, and that are also inexpensive. Stands made of wood do not fold easily, stands made of metal are heavy and expensive. Stands made of plastic materials are unstable and may collapse under excessive weight. It would therefore be highly advantageous to have, a display system and method devoid of the above limitations.

SUMMARY OF THE INVENTION

According to one aspect of the present invention there is provided a display system for storing articles for display, the display system including a board (or sheet) of multiwall structure of polypropylene material, the board comprising two parallel vertical folds dividing the board into a back-plane part, a left side part and a right side part, the side parts being foldable with respect to the back-plane, where the back-plane part includes a plurality of horizontal slots, and the right side part and the left side part including a plurality of holes, each hole associated with a slot of the plurality of slots, a plurality of rods, preferably an aluminum profile, where each rod is insertable through a hole in the right part and a corresponding hole in the left part, and a plurality of shelves made of multiwall structure of polypropylene material, each shelf including at least one flap, where each shelf rests on a rod and its flaps inserted in corresponding slots in the back plane.

According to another aspect of the present invention there is provided a display system for storing articles for display, the display system including: a ladder part constructed to support weight, an envelop part constructed to provide stability, and a plurality of shelves constructed for placing articles, the shelves coupled with the envelop part and with the ladder part to enable folding, where the folding enables a first folding mode enabling placement of articles on the shelves and a second folding mode where the display system consumes a volume smaller than the volume of the first folding mode.

According to yet another aspect of the present invention there is provided a display system where the envelop part includes a back part and where the ladder part, the back part and the shelves form a parallelogram and where the folding affects the parallelogram's angles.

According to still another aspect of the present invention there is provided a display system where the first folding mode separates between the back part and the ladder part and where the second folding mode bring the back part and the ladder part closer.

Further according to another aspect of the present invention there is provided a display system where the ladder part includes a rigid material, and where the envelop part includes a flexible material.

Still further according to another aspect of the present invention there is provided a display system where the ladder part includes a vertical part including a rigid material, and a horizontal part including a vertically flat material.

Yet further according to another aspect of the present invention there is provided a display system where at least one of the ladder part, the envelop part, and the shelf includes a multiwall structure of polypropylene material.

Even further according to another aspect of the present invention there is provided a display system where at least one of the envelop part, and the shelf includes a plastic sheet.

Additionally according to another aspect of the present invention there is provided a display system where the envelop part includes a plurality of slots, and where the shelves include at least one flap insertable into a slot of the plurality of slots, and where the flap when inserted into the slot includes an axle about which the shelve is rotatable relative to the envelop part to enable the folding.

According to yet another aspect of the present invention there is provided a display system additionally including a fastener part for fastening the envelop part to the ladder part.

According to still another aspect of the present invention there is provided a display system where the fastener includes at least one of: a rivet, a slotted spring pin, a bayonet type clamp, and a magnet.

Further according to another aspect of the present invention there is provided a display system where the envelop part includes a back part and at least one side part and where the at least one of the side part is foldable with respect to the back part at least one of: along the back part, in parallel to the back part, and forming an angle with the back part.

Still further according to another aspect of the present invention there is provided a display system where the envelop part includes a fold between the back part and the at least one side part and where the fold includes a half-depth cut.

Yet further according to another aspect of the present invention there is provided a display system the shelves are constructed to transfer weight of the article to the horizontal part and where the horizontal part is constructed to transfer the weight to the vertical part and where the vertical part is constructed to transfer the weight to the floor.

Even further according to another aspect of the present invention there is provided a display system additionally including a connector part constructed to connect at least two parts from the list consisting of: two vertical parts, a vertical part and a horizontal part, and a vertical part and the envelope part.

Additionally according to another aspect of the present invention there is provided a display system where the connector part is constructed to slide on the vertical part.

According to still another aspect of the present invention there is provided a display system where the connector part includes a dovetail joint.

Unless otherwise defined, all technical and scientific terms used herein have the same meaning as commonly understood by one of ordinary skill in the art to which this invention belongs. The materials, methods, and examples provided herein are illustrative only and not intended to be limiting. Implementation of the method and system of the present invention involves performing or completing certain selected tasks or steps manually, automatically, or a combination thereof.

BRIEF DESCRIPTION OF THE DRAWINGS

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in order to provide what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings:

FIG. 14A is a simplified illustration of the floor base in closed mode;

FIG. 14B is a simplified illustration of the floor base in opened mode;

FIG. 15 is a simplified illustration of the floor base assembled with the back-base in opened mode;

FIG. 16A is a simplified illustration of a full view of the assembled back-base and floor base in opened mode; and FIG. 16B is a simplified illustration of a full view of the back-base and floor base assembled and folded;

FIG. 18A is a simplified illustration of a back base part of the modular vertical folding stand in flat-open mode;

FIG. 18B is a simplified illustration of the back base part in folded mode, with the side parts folded;

FIG. 19 is a simplified illustration of a center frame part of the modular vertical folding stand;

FIG. 20 is a simplified illustration of a base floor part of the modular vertical folding stand;

FIG. 21 is a simplified illustration of a shelf part of the modular vertical folding stand;

FIG. 23A is a simplified illustration of a front view of a modular adjustable vertical folding stand;

FIG. 23B is a simplified illustration of a side view of the modular adjustable vertical folding stand;

FIG. 23C is a simplified illustration of a top view of the modular adjustable vertical folding stand;

FIG. 23D is a simplified illustration of an isometric view of the modular adjustable vertical folding stand;

FIG. 24 is a simplified illustration of a back base part of the modular adjustable vertical folding stand;

FIG. 25 is a simplified illustration of a shelf part of the modular adjustable vertical folding stand;

FIG. 26 is a simplified illustration of a base floor part of the modular adjustable vertical folding stand;

FIGS. 27A and 27B are simplified illustrations of a profile part of the modular adjustable vertical folding stand;

FIGS. 28A, 28B and 28C are simplified illustrations of a connector part of the modular adjustable vertical folding stand;

FIG. 29 is a simplified illustration of a connector and a fastener;

FIG. 30 is a simplified illustration of the connector with the fastener assembled together;

FIG. 31 is a simplified illustration of the connector, two profiles and the fastener;

FIG. 32 is a simplified illustrations of an assembled ladder part including connectors, profiles, and fasteners;

FIG. 33 is a simplified illustration of a side part connected to the ladder part with fasteners;

FIG. 34 is a detail of FIG. 33 showing a part of the side part and a fastener;

FIGS. 35A, 35B, and 35C, are simplified illustrations of a continuously adjustable connector;

FIG. 36 is a simplified illustration of the continuously adjustable connector with profiles and a fastener;

FIGS. 37 and 38 are simplified illustrations of the continuously adjustable connector assembled with profiles;

FIGS. 43A and 43B are simplified illustrations of a reverse-T profile;

FIGS. 44A, 44B and 44C are simplified illustrations of different views of a continuously adjustable connector compatible with the profile of FIGS. 43A and 43B;

FIG. 64A and FIG. 64B are simplified illustrations of two folding configurations of the base part 39;

FIGS. 65A, 65B, and 65C are simplified illustrations of three folding position of the assembled back part 37 and beam part 38;

DESCRIPTION OF THE PREFERRED EMBODIMENTS

Figure 1C:
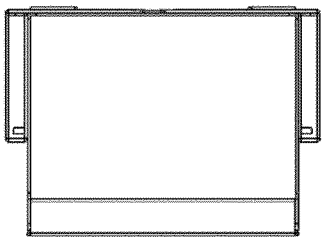
FIG. 1C is a simplified illustration of a top view of the modular folding stand.

The principles and operation of a display system according to the present invention may be better understood with reference to the drawings and accompanying description.

Before explaining at least one embodiment of the invention in detail, it is to be understood that the invention is not limited in its application to the details of construction and the arrangement of the components set forth in the following description or illustrated in the drawings. The invention is capable of other embodiments or of being practiced or carried out in various ways. In addition, it is to be understood that the phraseology and terminology employed herein is for the purpose of description and should not be regarded as limiting.

In this document the term "display system" refers to a structure that includes shelves for placing articles for display and/or for sale and/or for storage. This "display system" is also called "stand", "rack", "point of sale display", "point of sale stand", etc.

The present invention includes a foldable display system preferably made of plastic material, preferably corrugated plastic, which may also be referred to as twinwall plastic, corrugated fiberboard, multiwall structure, extruded plastic sheet, etc. or combinations of these terms. The plastic material used is preferably in the form of a board, or a plane or a sheet having thickness of few millimeters. The plastic material is preferably polypropylene, or high impact polypropylene resin, though other materials are possible. In this document this material in preferably called multiwall board, however, other terms and their combinations are possible. The multiwall board preferably includes two (or more) sheets (or surfaces) separated by a structure of spacers forming a structure of long tunnels or bores. The direction of the tunnels is named herein fiber direction.

Reference is now made to FIGS. 1A, 1B, 1C and 1D, which are simplified illustrations of several views of modular folding stand 10 according to a preferred embodiment of the present invention.

Figure 1D:
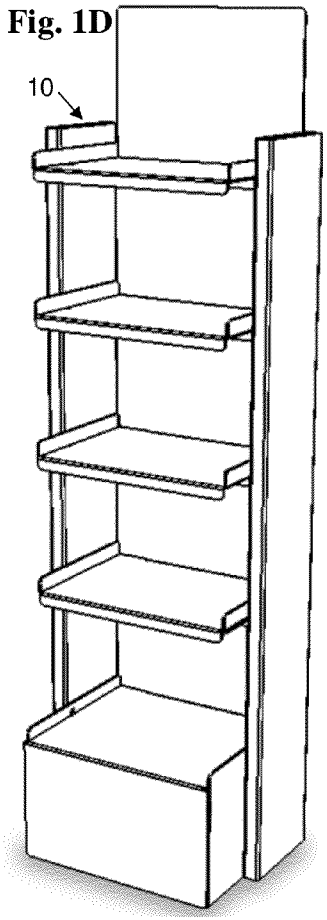
FIG. 1D is a simplified illustration of an isometric view of the modular folding stand.
Figure 1B:
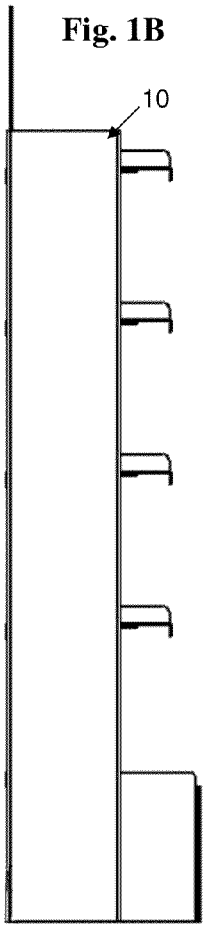
FIG. 1B is a simplified illustration of a side view of the modular folding stand.
Figure 1A:
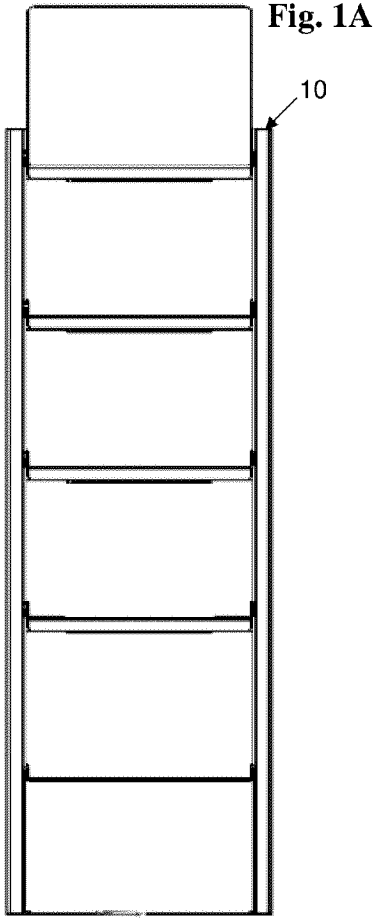
FIG. 1A is a simplified illustration of a front view of a modular folding stand—full beam configuration.

FIG. 1A is a simplified illustration of a front view of a modular folding stand 10.

FIG. 1B is a simplified illustration of a side view of the modular folding stand 10.

FIG. 1C is a simplified illustration of a top view of a modular folding stand 10.

FIG. 1D is a simplified illustration of an isometric view of a modular folding stand 10.

The modular folding stand 10 is a display system as described above. The modular folding stand 10 is preferably made of, at least partly, multiwall board as described above. The modular folding stand 10 has two basic configurations or modes: a closed mode and an open mode. Optionally, the open mode may be called assembled mode or positioning mode while the closed mode may be called flat mode. FIGS. 1A-1*d* depict the modular folding stand 10 in the open or assembled mode.

The various configurations of the modular folding stand 10 are made possible by half-depth cuts into the material. Such half-depth cuts enable the folding of the multiwall board. There are two basic types of half-depth cuts: half-depth cuts along the fiber direction (such as along a tunnel) and half-depth cuts across the fiber direction.

Figure 2B:
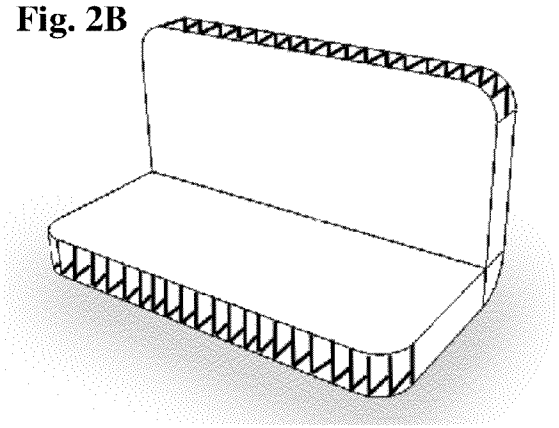
FIG. 2B is a simplified illustration of the multiwall board of FIG. 2A in a folded mode.
Figure 2A:
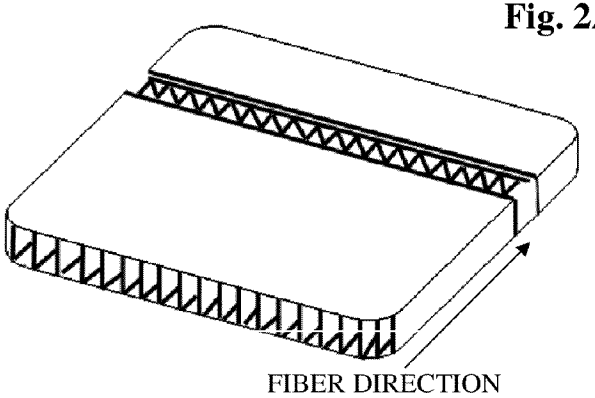
FIG. 2A is a simplified illustration of a multiwall board in a flat mode showing a half-depth cut across the tunnels.

Reference is now made to FIGS. 2A and 2B, which are simplified illustrations of two views of a multiwall board with a half-depth cut across fiber direction, as used in the modular folding stand 10 according to a preferred embodiment of the present invention.

FIG. 2A is a view of the multiwall board in a flat mode showing the half-depth cut across the tunnels while FIG. 2B is a view of the multiwall board in a folded mode.

Figure 3B:
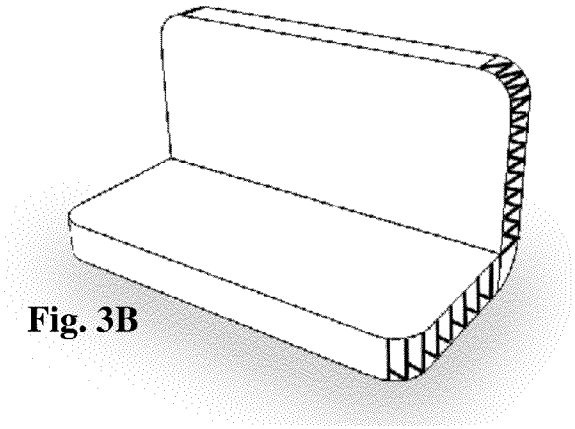
FIG. 3B is a simplified illustration of the multiwall board of FIG. 3A in a folded mode.
Figure 3A:
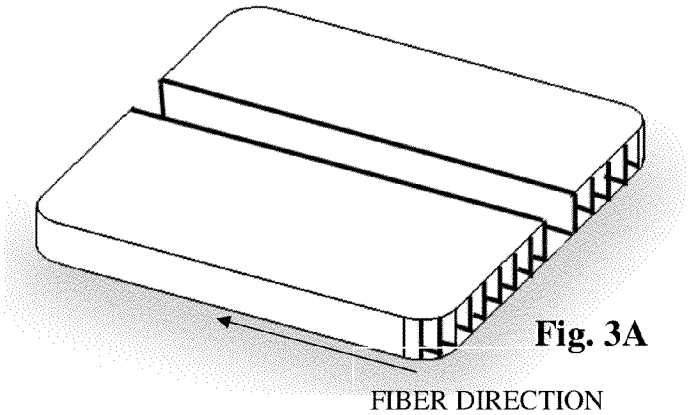
FIG. 3A is a simplified illustration of a multiwall board in a flat mode showing a half-depth cut across the tunnels.

Reference is now made to FIGS. 3A and 3B, which are simplified illustrations of two views of a multiwall board with a half-depth cut along fiber direction, as used in the modular folding stand 10 according to a preferred embodiment of the present invention.

FIG. 3A is a view of the multiwall board in a flat mode showing the half-depth cut along a tunnel while FIG. 3B is a view of the multiwall board in a folded mode.

Reference is now made to FIGS. 4, 5, 6, 7, 8, 9, and 10, which are simplified illustrations of elements of the modular folding stand 10 according to a preferred embodiment of the present invention.

Figure 4:
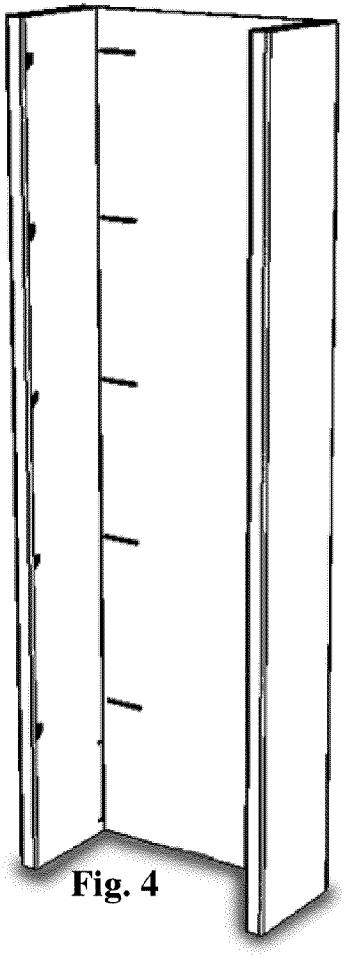
FIG. 4 is a simplified illustration of a back base part of the modular folding stand.

FIG. 4 shows a back base in open mode.

Figure 5:
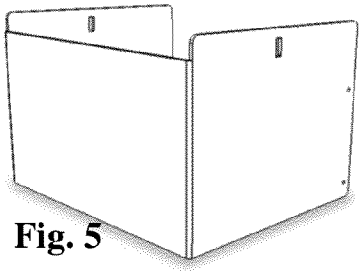
FIG. 5 is a simplified illustration of a floor base part of the modular folding stand.

FIG. 5 shows a floor base in open mode.

Figure 6:
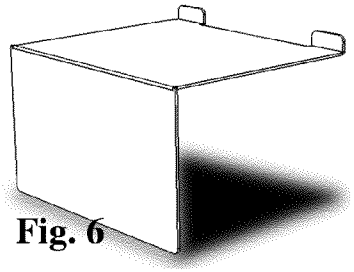
FIG. 6 is a simplified illustration of a base shelf part of the modular folding stand.

FIG. 6 shows a base shelf in open mode.

Figure 7:
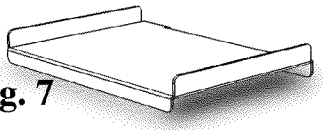
FIG. 7 is a simplified illustration of a shelf part of the modular folding stand.

FIG. 7 shows a shelf, of which the modular folding stand 10 preferably includes four units, however, any other number is possible.

Figure 8:
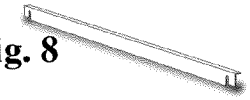
FIG. 8 is a simplified illustration of a base rod part of the modular folding stand.

FIG. 8 shows a rod, of which the modular folding stand 10 preferably includes four units as there are shelves, however, any other number is possible. The rod is preferably an aluminum profile.

Figure 9:
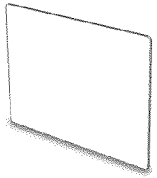
FIG. 9 is a simplified illustration of a header part of the modular folding stand.

FIG. 9 shows a header.

Figure 10:
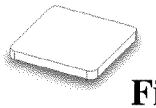
FIG. 10 is a simplified illustration of a stopper part of the modular folding stand.

FIG. 10 shows a stopper, of which the modular folding stand 10 preferably includes four units as there are shelves, however, any other number is possible.

Typically but preferably, however as a non-limiting example, modular folding stand 10 includes the following elements:

| Element | Quantity |
|---|---|
| Back Base | 1 |
| Floor Base | 1 |
| Base Shelf | 1 |
| Shelf | 4 |
| Aluminum Profile | 4 |
| Stopper | 4 |
| Header | 1 |

Reference is now made to FIGS. 11A, 11B, 12 and 13, which are simplified illustration of the back base of FIG. 4 according to a preferred embodiment of the present invention.

Figure 11B:
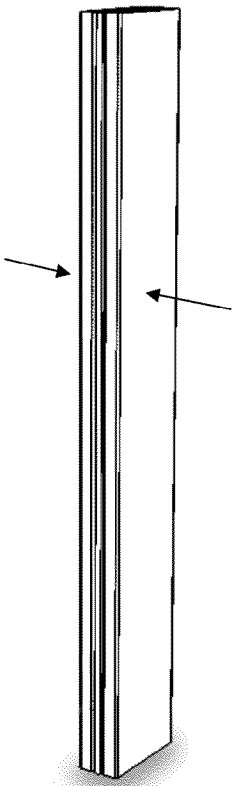
FIG. 11B is a simplified illustration of the back base in closed mode.
Figure 11A:
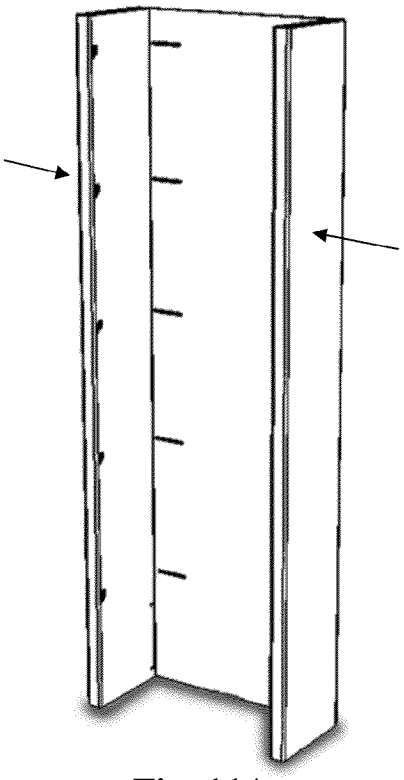
FIG. 11A is a simplified illustration of the back base in open mode with a vertical half-cut in the center.

FIG. 11A shows the back base in open mode with a vertical half-cut in the center.

FIG. 11B shows the back base in closed mode.

Figure 12:
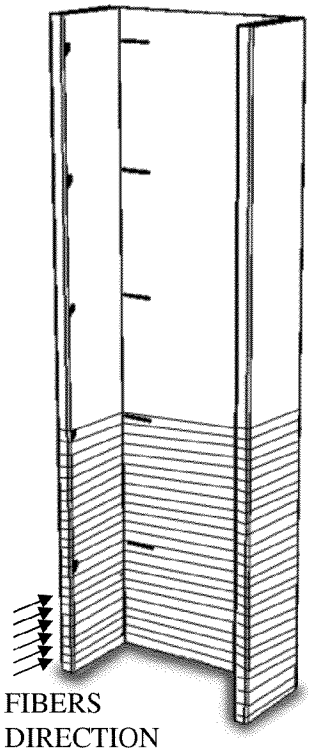
FIG. 12 is a simplified illustration of the back base with the folding half-cuts across the fiber direction.

FIG. 12 shows the back base with horizontal fiber direction and the folding half-cuts across the fiber direction.

Figure 13:
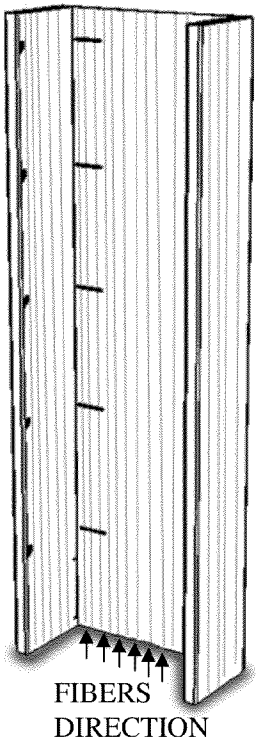
FIG. 13 is a simplified illustration of the back base with the folding half-cuts along the fiber direction.

FIG. 13 shows the back base with vertical fiber direction and the folding half-cuts along the fiber direction.

Reference is now made to FIGS. 14A, 14B, 15, 16A, and 16B which are simplified illustrations of folding details of the modular folding stand 10 according to a preferred embodiment of the present invention.

FIG. 14A shows the floor base in closed mode.

FIG. 14B shows the floor base in opened mode.

FIG. 15 shows the floor base assembled with the back-base in opened mode.

FIG. 16A is a full view of the assembled back-base and floor base in opened mode.

FIG. 16B is a full view of the back-base and floor base assembled and folded.

Reference is now made to FIGS. 17A, 17B, 17C and 17D, which are simplified illustrations of several views of a modular vertical folding stand 11 according to a preferred embodiment of the present invention.

Figure 17C:
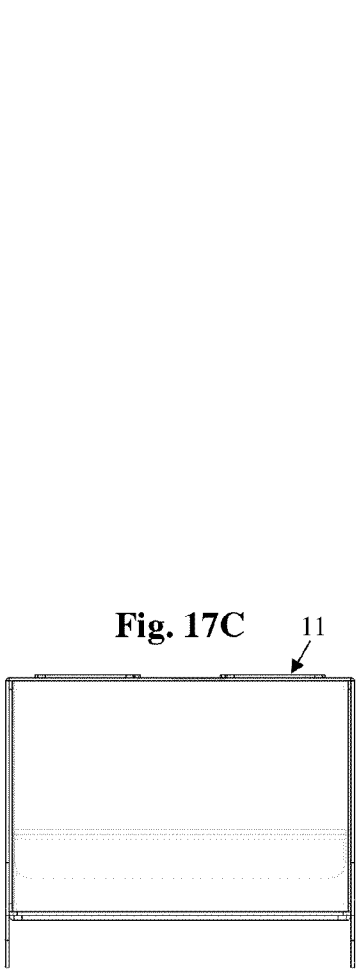
FIG. 17C is a simplified illustration of a top view of the modular vertical folding stand.
Figure 17D:
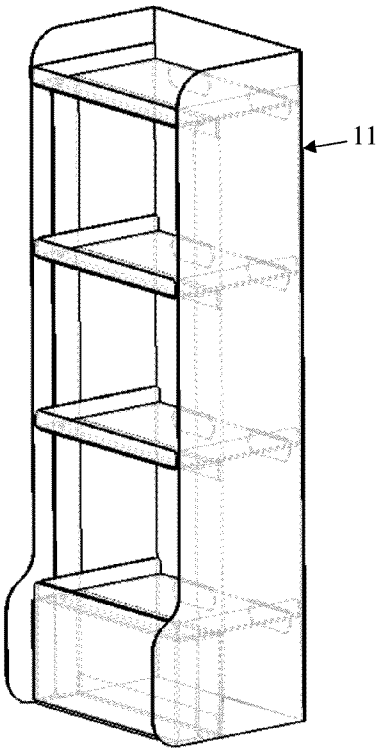
FIG. 17D is a simplified illustration of an isometric view of the modular vertical folding stand.
Figure 17B:
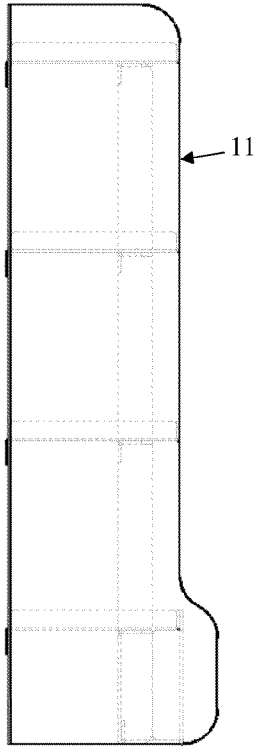
FIG. 17B is a simplified illustration of a side view of the modular vertical folding stand.
Figure 17A:
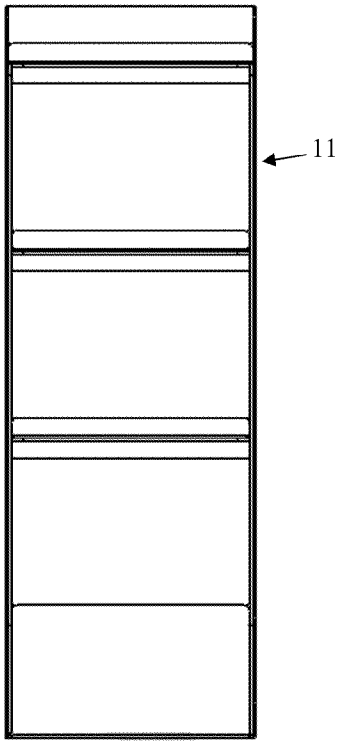
FIG. 17A is a simplified illustration of a front view of a modular vertical folding stand.

FIG. 17A is a simplified illustration of a front view of the modular vertical folding stand 11.

FIG. 17B is a simplified illustration of a side view of the modular vertical folding stand 11.

FIG. 17C is a simplified illustration of a top view of the modular vertical folding stand 11.

FIG. 17D is a simplified illustration of an isometric view of the modular vertical folding stand 11.

The modular vertical folding stand 11 is a display system as described above. The modular vertical folding stand 11 is preferably made, at least partly, from multiwall board as described above. FIGS. 17A-17D depict the modular vertical folding stand 11 in fully assembled mode.

Various modes of certain elements of the modular vertical folding stand 11 are made possible by half-depth cuts into the material as described above with reference to FIGS. 2A and 2B. Such half-depth cuts enable the folding of the multiwall board. As described above, there are two basic types of half-depth cuts: half-depth cuts along the fiber direction (such as along a tunnel) and half-depth cuts across the fiber direction.

Reference is now made to FIGS. 18A, 18B, 19, 20, and 21, which are simplified illustrations of elements of the modular vertical folding stand 11 according to a preferred embodiment of the present invention.

FIG. 18A shows a back base part 12 in flat-open mode. FIG. 18A also shows the fiber direction and two half-depth cuts 13 along the fiber direction enabling the folding of the side parts 14. FIG. 18A also shows shelves slots 15. FIG. 18B shows the back base part in folded mode, with the side parts folded preferably in 90 degrees.

FIG. 19 shows a center frame part 16.

FIG. 20 shows a base floor part 17.

FIG. 21 shows a shelf part 18.

Figure 22C:
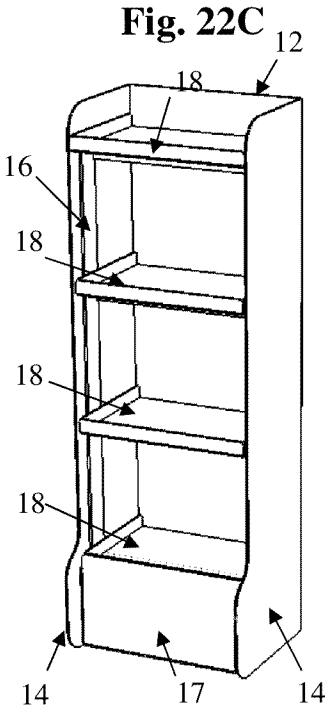
FIG. 22C is a simplified illustration of the modular vertical folding stand fully assembled mode, with the sides folded in and the shelves folded upright.
Figure 22B:
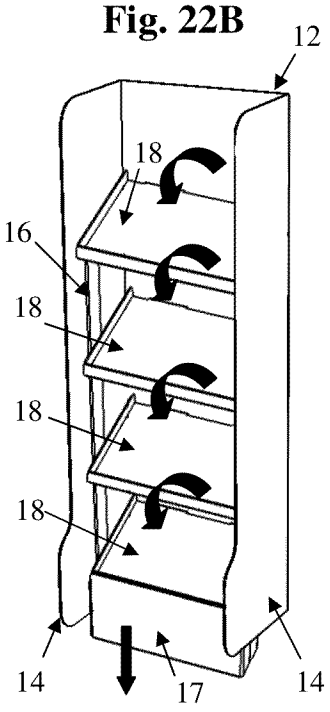
FIG. 22B is a simplified illustration of the modular vertical folding stand assembled in a folded-down mode, with the sides folded in and the shelves folded down.
Figure 22A:
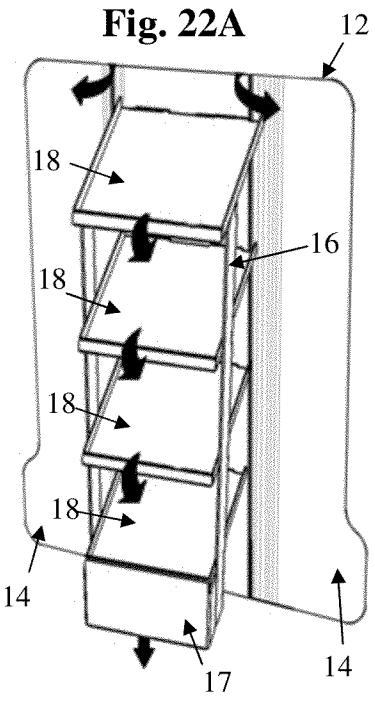
FIG. 22A is a simplified illustration of the modular vertical folding stand assembled in a flat-open mode, with the sides flat-folded and the shelves folded down.

Reference is now made to FIGS. 22A, 22B and 22C, which are simplified illustrations of the modular vertical folding stand 11 in various folding modes according to a preferred embodiment of the present invention.

FIG. 22A shows the modular vertical folding stand 11 assembled in a flat-open mode, with the sides flat-folded and the shelves folded down.

FIG. 22B shows the modular vertical folding stand 11 assembled in a folded-down (closed) mode, with the sides folded in and the shelves folded down.

FIG. 22C shows the modular vertical folding stand 11 fully assembled mode, with the sides folded in and the shelves folded up.

It is appreciated that FIGS. 18A-22C may not depict their respective elements, or components, or parts according to the same scale.

As a non-limiting example, the modular folding stand 10 is typically but preferably made of the following components:

| Component | Quantity |
|---|---|
| Back Base | 1 |
| Center Frame | 1 |
| Floor Base | 1 |
| Shelf | 3-4 |

Reference is now made to FIGS. 23A, 23B, 23C and 23D, which are simplified illustrations of several views of a modular adjustable vertical folding stand 19 according to a preferred embodiment of the present invention.

FIG. 23A is a simplified illustration of a front view of the modular adjustable vertical folding stand 19.

FIG. 23B is a simplified illustration of a side view of the modular adjustable vertical folding stand 19.

FIG. 23C is a simplified illustration of a top view of the modular adjustable vertical folding stand 19.

FIG. 23D is a simplified illustration of an isometric view of the modular adjustable vertical folding stand 19.

The modular adjustable vertical folding stand 19 is a display system as described above. The modular adjustable vertical folding stand 19 is preferably made, at least partly, from multiwall board as described above. FIGS. 23A-23D depict the modular adjustable vertical folding stand 19 in fully assembled mode.

Various modes of certain elements of the modular adjustable vertical folding stand 19 are made possible by half-depth cuts into the material as described above with reference to FIGS. 2A and 2B. Such half-depth cuts enable the folding of the multiwall board. As described above, there are two basic types of half-depth cuts: half-depth cuts along the fiber direction (such as along a tunnel) and half-depth cuts across the fiber direction.

Reference is now made to FIGS. 24, 25, 26, 27A, 27B, 28A, 28B and 28C, which are simplified illustrations of elements of the modular adjustable vertical folding stand 19 according to a preferred embodiment of the present invention.

FIG. 24 shows a back base part 20 of the modular adjustable vertical folding stand 19 with side parts 21 folded forward. The back base part 20 is preferably made of a board of multiwall structure of polypropylene material.

FIG. 25 shows a shelf part 22 of the modular adjustable vertical folding stand 19. The shelf part 22 is preferably made of a board of multiwall structure of polypropylene material.

FIG. 26 shows a base floor part 23 of the modular adjustable vertical folding stand 19. The base floor part 23 is preferably made of a board of multiwall structure of polypropylene material.

FIGS. 27A and 27B are two illustrations of a profile part 24 of the modular adjustable vertical folding stand 19, preferably made of plastic material, preferably solid plastic.

FIGS. 28A, 28B and 28C are three illustrations of a connector part 25 of the modular adjustable vertical folding stand 19, preferably made of plastic material, preferably solid plastic.

Reference is now made to FIGS. 29, 30, 31, 32, 33, and 34, which are simplified illustrations of steps of the assembly of the modular adjustable vertical folding stand 19 according to a preferred embodiment of the present invention.

FIG. 29 shows a connector 25 and a fastener 26.

FIG. 30 shows the connector 25 with the fastener 26 assembled together.

FIG. 31 shows the connector 25, two profiles 24 and the fastener 26. As shown in FIG. 31, profile 24 is a tube made of a plastic material. A profile 24 is preferably square, but may have other shapes. A connector 25 enables the assembly of two or more profiles 24. The fastener 26 enables the fastening of a side part 21 to the connector 25.

FIG. 32 shows an assembled ladder part 27 including connectors 25, profiles 24 and fasteners 26. By using profiles 24 of various lengths it is possible to assemble a ladder of various dimensions and shapes. For example, adjusting the width of the ladder, adjusting the height between the shelves, adjusting the number of shelves, adjusting overall height, etc.

FIG. 33 shows a side part 21 connected to the ladder part with fasteners 26.

FIG. 34 is a detail of FIG. 33 showing the side part 21 and a fastener 26.

As a non-limiting example, the modular adjustable folding stand 19 is typically but preferably made of the following components:

| Component | Quantity |
|---|---|
| Back Base | 1 |
| Floor Base | 1 |
| Shelf | 4 |
| Plastic profile | 14 |
| Plastic profile connector | 8 |

The modular adjustable folding stand 19, when assembled, such as the modular folding stand 10, has folding capabilities as shown and described with reference to FIGS. 22A, 22B and 22C. Particularly, The modular adjustable folding stand 19, has upward and downward folding motion as depicted in FIGS. 22B and 22C.

Reference is now made to FIGS. 35A, 35B, and 35C, which are simplified illustrations of a continuously adjustable connector 28, according to a preferred embodiment of the present invention.

Reference is now made to FIGS. 36, 37, and 38, which are simplified illustrations of the continuously adjustable connector 28 and profiles 29, according to a preferred embodiment of the present invention.

The continuously adjustable connector 28 and the profiles 29 are preferably made of plastic material, preferably solid plastic. As shown in FIGS. 37 and 38, the continuously adjustable connector 28 may slide over the profile 29 continuously.

FIG. 36 also shows a fastener 30 for fastening the continuously adjustable connector 28 to a board such as a board made of multiwall structure of polypropylene material, for example, the back base part 20 shown and described with reference to FIG. 24.

Figure 39:
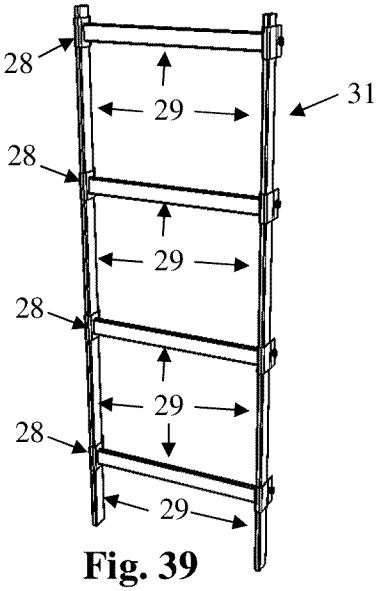
FIG. 39 is a simplified illustration of a ladder made of connectors and profiles.

Reference is now made to FIG. 39, which is a simplified illustration of a ladder 31, according to a preferred embodiment of the present invention. Ladder 31 is made of continuously adjustable connectors 28 and profiles 29 as shown in FIG. 39.

Figure 40:
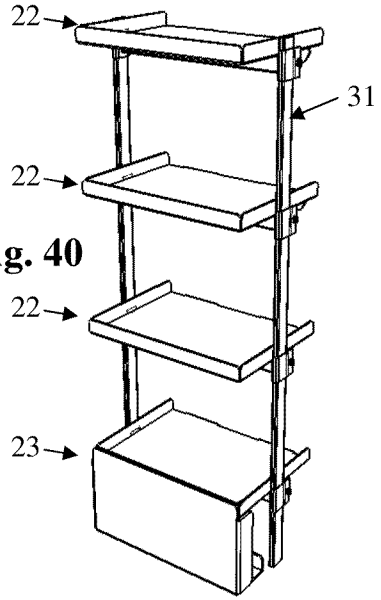
FIG. 40 is a simplified illustration of shelves 22 and base floor 23 mounted on a ladder.

Reference is now made to FIG. 40, which is a simplified illustration of shelves 22 and base floor 23 mounted on a ladder 31, according to a preferred embodiment of the present invention.

Figure 42:
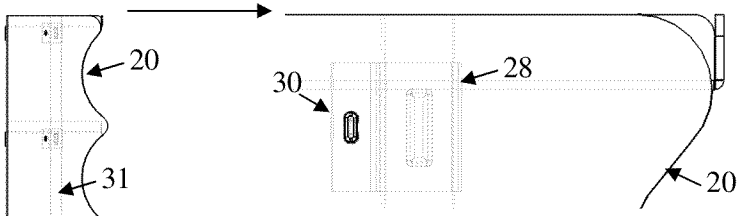
FIG. 42 is a simplified illustration of a detail of FIG. 41, showing a fastener connecting the side to the ladder.
Figure 41:
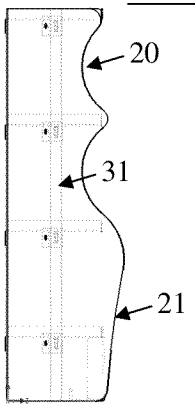
FIG. 41 is a simplified illustration of the side of the back base part connected to the ladder.

Reference is now made to FIG. 41, which is a simplified illustration of the side 21 of the back base part 20 connected to the ladder 31, and to FIG. 42, which is a simplified illustration of a detail of FIG. 41, showing the side 21 connected to a connector 28 of the ladder 31 using a fastener 30, according to a preferred embodiment of the present invention.

The modular adjustable folding stand assembled using the continuously adjustable connector 28 has folding capabilities as shown and described with reference to FIGS. 22A, 22B and 22C. Particularly, This modular adjustable folding stand, has upward and downward folding motion as depicted in FIGS. 22B and 22C. As a non-limiting example, the modular adjustable folding stand is typically but preferably made of the following components:

| Component | Quantity |
|---|---|
| Back Base | 1 |
| Floor Base | 1 |
| Shelf | 4 |
| Plastic profile | 14 |
| Plastic profile connector | 8 |

Reference is now made to FIGS. 43A, and 43B, which are simplified illustrations of a reverse-T profile 32, according to a preferred embodiment of the present invention.

Reference is now made to FIGS. 44A, 44B and 44C, which are simplified illustrations of different views of a continuously adjustable connector 33 compatible with profile 32, according to a preferred embodiment of the present invention.

Figure 45:
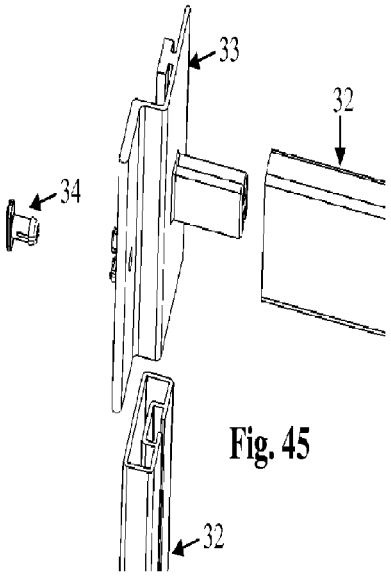
FIG. 45 is a simplified illustration of a continuously adjustable connector, the profiles and a fastener.
Figure 46:
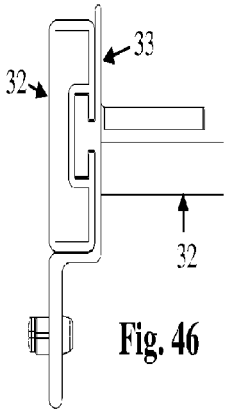
FIG. 46 and FIG. 47 are simplified illustrations of exemplary assemblies of the continuously adjustable connector and profiles.
Figure 47:
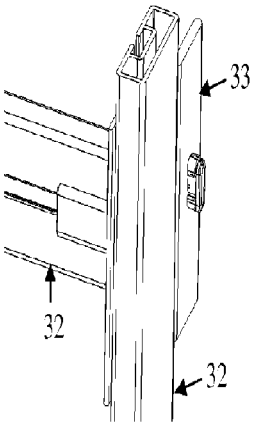

Reference is now made to FIGS. 45, 46, and 47, which are simplified illustrations of the continuously adjustable connector 33 and profiles 32, according to a preferred embodiment of the present invention.

The continuously adjustable connector 33 and the profiles 32 are preferably made of plastic material, preferably solid plastic. As shown in FIGS. 46 and 47, the continuously adjustable connector 33 may slide over the profile 32 continuously.

FIG. 45 also shows a fastener 34 for fastening the continuously adjustable connector 28 to a board such as a board made of multiwall structure of polypropylene material, for example, the back base part 20 shown and described with reference to FIG. 24.

Figure 48:
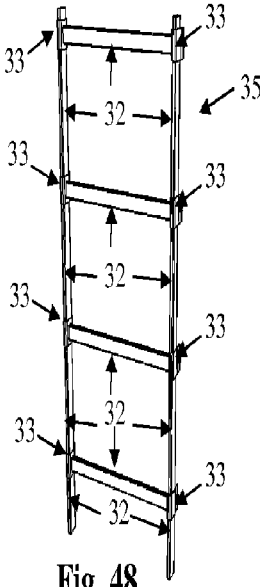
FIG. 48 is a simplified illustration of a ladder made of continuously adjustable connectors and profiles.

Reference is now made to FIG. 48, which is a simplified illustration of a ladder 35, according to a preferred embodiment of the present invention. Ladder 35 is made of continuously adjustable connectors 33 and profiles 32 as shown in FIG. 41.

Figure 49:
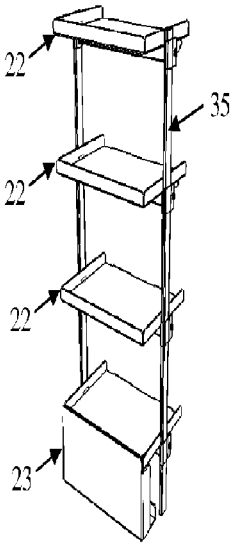
FIG. 49 is a simplified illustration of shelves and base floor mounted on the ladder of FIG. 48.

Reference is now made to FIG. 49, which is a simplified illustration of shelves 22 and base floor 23 mounted on a ladder 31, according to a preferred embodiment of the present invention.

The modular adjustable folding stand assembled using the continuously adjustable connector 28 has folding capabilities as shown and described with reference to FIGS. 22A, 22B and 22C. Particularly, This modular adjustable folding stand, has upward and downward folding motion as depicted in FIGS. 22B and 22C. As a non-limiting example, the modular adjustable folding stand is typically but preferably made of the following components:

| Component | Quantity |
|---|---|
| Back Base | 1 |
| Floor Base | 1 |
| Shelf | 4 |
| Plastic profile | 14 |
| Plastic profile connector | 8 |

Reference is now made to FIGS. 50A, 50B, 50C and 50D, which are simplified illustrations of several views of a fully folding stand 36 according to a preferred embodiment of the present invention.

Figure 50C:
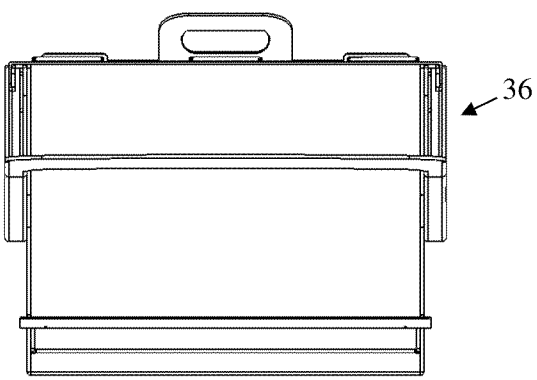
FIG. 50C is a simplified illustration of a top view of the fully folding stand.
Figure 50D:
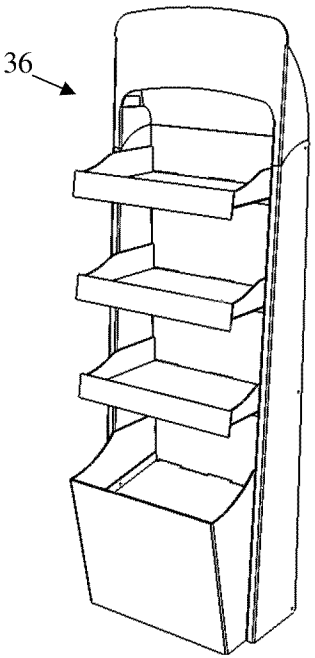
FIG. 50D is a simplified illustration of an isometric view of the fully folding stand.
Figure 50B:
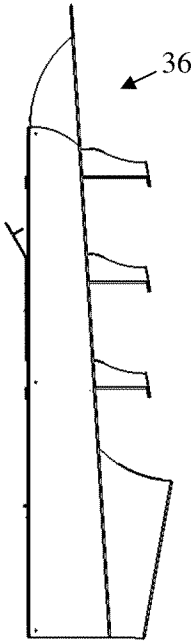
FIG. 50B is a simplified illustration of a side view of the fully folding stand.
Figure 50A:
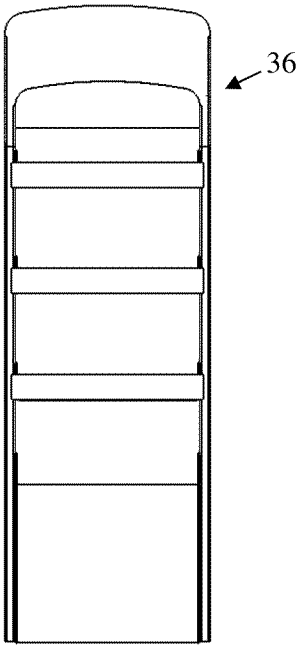
FIG. 50A is a simplified illustration of a front view of the fully folding stand.

FIG. 50A is a simplified illustration of a front view of the fully folding stand 36.

FIG. 50B is a simplified illustration of a side view of the fully folding stand 36.

FIG. 50C is a simplified illustration of a top view of the fully folding stand 36.

FIG. 50D is a simplified illustration of an isometric view of the fully folding stand 36.

The fully folding stand 36 is a display system as described above. The fully folding stand 36 is preferably made, at least partly, from multiwall board as described above. FIGS. 50A-50D depict the fully folding stand 36 in assembled mode.

Various modes of certain elements of the fully folding stand 36 are made possible by half-depth cuts into the material as described above with reference to FIGS. 2A and 2B. Such half-depth cuts enable the folding of the multiwall board. As described above, there are two basic types of half-depth cuts: half-depth cuts along the fiber direction (such as along a tunnel) and half-depth cuts across the fiber direction.

Reference is now made to FIGS. 51, 52, 53, 54, 55, 56, 57, 58, 59, and 60, which are simplified illustrations of elements of the fully folding stand 36, according to a preferred embodiment of the present invention.

Figure 51:
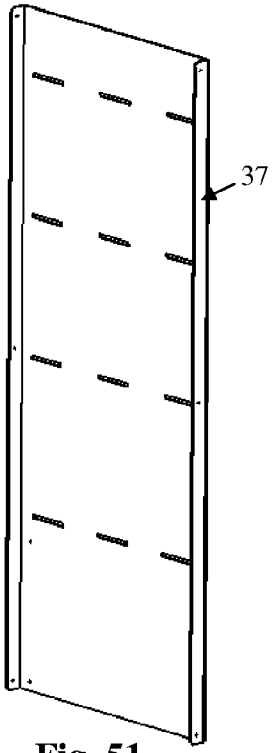
FIG. 51 is a simplified illustrations of a base back part of a fully folding stand.

FIG. 51 is a simplified illustrations of a back part 37 of the fully folding stand 36.

Figure 52:
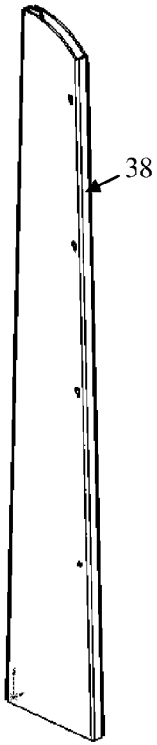
FIG. 52 is a simplified illustrations of a beam part of the fully folding stand.

FIG. 52 is a simplified illustrations of a beam part 38 of the fully folding stand 36.

Figure 53:
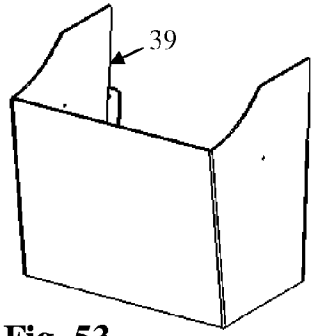
FIG. 53 is a simplified illustrations of a floor base part of the fully folding stand.

FIG. 53 is a simplified illustrations of a base part 39 of the fully folding stand 36.

Figure 54:
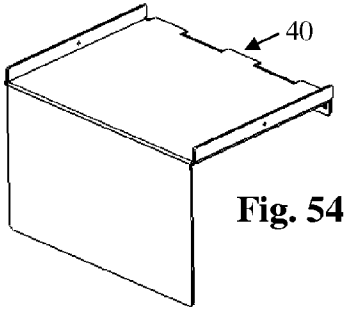
FIG. 54 is a simplified illustrations of a base shelf part of the fully folding stand.

FIG. 54 is a simplified illustrations of a base shelf part 40 of the fully folding stand 36.

Figure 55:
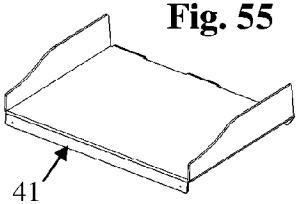
FIG. 55 is a simplified illustrations of a shelf part of the fully folding stand.

FIG. 55 is a simplified illustrations of a shelf part 41 of the fully folding stand 36.

Figure 56:
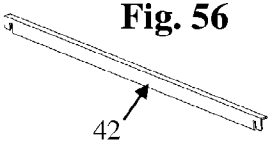
FIG. 56 is a simplified illustrations of a profile part of the fully folding stand.

FIG. 56 is a simplified illustrations of a profile part 42 of the fully folding stand 36.

Figure 57:
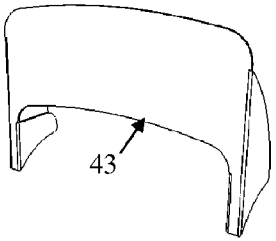
FIG. 57 is a simplified illustrations of a header part of the fully folding stand.

FIG. 57 is a simplified illustrations of a header part 43 of the fully folding stand 36.

Figure 58:
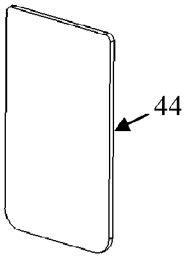
FIG. 58 is a simplified illustrations of a header support part of the fully folding stand.

FIG. 58 is a simplified illustrations of a header support part 44 of the fully folding stand 36.

Figure 59:
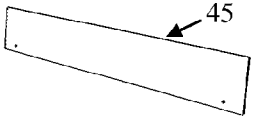
FIG. 59 is a simplified illustrations of a shelf cover part of the fully folding stand.

FIG. 59 is a simplified illustrations of a shelf cover part 45 of the fully folding stand 36.

Figure 60:
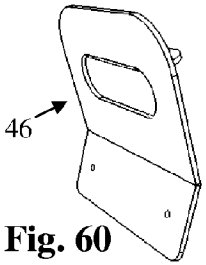
FIG. 60 is a simplified illustrations of a stand handle part of the fully folding stand.

FIG. 60 is a simplified illustrations of a stand handle part 46 of the fully folding stand 36.

Preferably, parts 37 to 46, with the exception of the profile 42, are made of multiwall structure of polypropylene material. Profile 42 is preferably made from aluminum.

Figure 63:
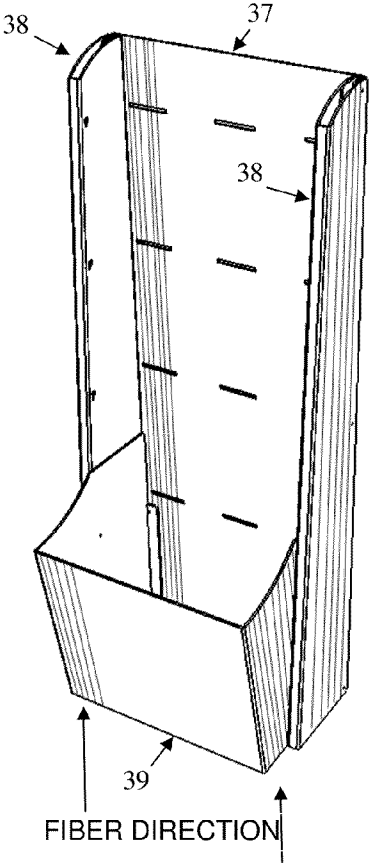
FIG. 63 is a simplified illustrations of the back part 37, the beam part 38, and the base part 39 assembled in a positioning configuration.
Figure 62:
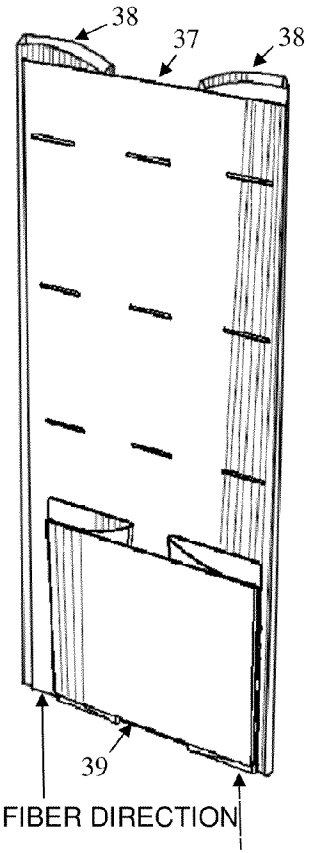
FIG. 62 is a simplified illustrations of the back part 37, the beam part 38, and the base part 39 assembled and positioned in a back-folded configuration.
Figure 61:
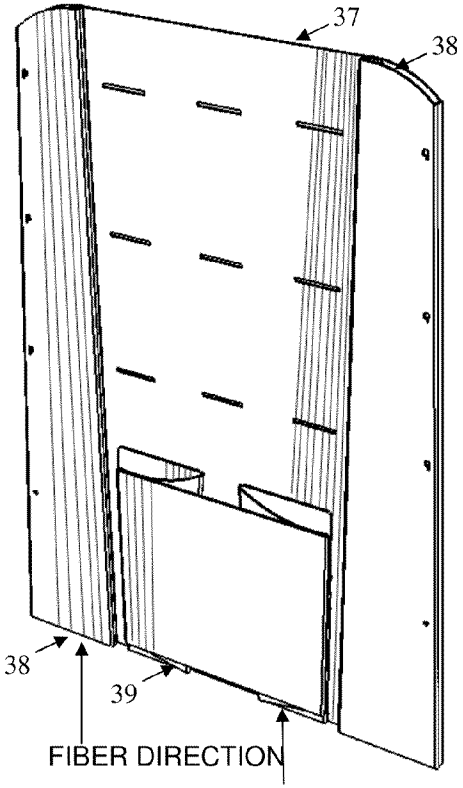
FIG. 61 is a simplified illustrations of the back part 37, the beam part 38, and the base part 39 assembled and positioned in a flat open folding configuration.

Reference is now made to FIGS. 61, 62, and 63, which are a simplified illustrations of three configurations of the back part 37, the beam part 38, and the base part 39 assembled together, according to a preferred embodiment of the present invention.

The three configuration shown by FIGS. 61-63 are three folding positions. FIG. 61 shows the assembled parts 37, 38, and 39 in a flat open folding configuration (for example for storage or transportation). FIG. 62 shows the assembled parts 37, 38, and 39 in a back-folded configuration (for example for storage or transportation). FIG. 63 shows the assembled parts 37, 38, and 39 in a positioning configuration (for example for display). FIGS. 61-63 also show the preferred fiber direction.

Reference is now made to FIG. 64A and FIG. 64B, which are simplified illustrations of two folding configurations of the base part 39 according to a preferred embodiment of the present invention. FIG. 64A shows the base part 39 in an open configuration while FIG. 64B shows the base part 39 in a closed or folded configuration. Arrows in FIGS. 64A and 64B show the directions of the folding motion.

Reference is now made to FIGS. 65A, 65B, and 65C, which are simplified illustrations of three folding position of the assembled back part 37 and beam part 38, according to a preferred embodiment of the present invention.

FIG. 65A shows the beam part 38 folded behind the back part 37. FIG. 65B shows the beam part 38 folded in front of the back part 37, and FIG. 65C shows the beam part 38 folded in a right angle to the back part 37. Arrows in FIGS. 65A and 65B show the folding motion while numeral 47 indicates the pivoting axle.

The modular adjustable folding stand 36 assembled has folding capabilities as shown and described above. As a non-limiting example, the modular adjustable folding stand is typically but preferably made of the following components:

| Component | Quantity |
|---|---|
| Back Base | 1 |
| Back handle | 1 |
| Beam | 2 |
| Floor Base | 1 |
| Shelf | 3 |
| Shelf cover | 3 |
| Aluminum profile | 3 |
| Header support | 4 |
| Header | 1 |

As shown and described above, the purpose of the present invention is a display system, which is a device for storing one or more articles for display. The device is usually used as a point of sale display, or point of sale stand. More particularly, but not exclusively, the purpose of the present invention is provide a foldable construction for presenting articles for sale. A display system according to the present invention is foldable to be comfortably carried around, easy to unfold and place in site, and large and stable enough to carry a large number of articles.

Preferably, a display system according to the present invention includes the following main parts: a ladder part, an envelop part, and one or more shelves. Additionally and optionally the display system may include one or more fastener parts, one or more support parts, and one or more accessory parts.

The ladder part preferably provides for carrying the weight of the articles presented The ladder part is preferably produced from a rigid material, preferably from metal or plastic material, preferably in the shape of a ladder constructed from vertical parts, horizontal parts and joints (connectors). The vertical and horizontal parts are preferably in the form of tubes that may have round or rectangular shape (cut) or any other type of profile (such as element 32). The tubes may have different lengths and the joints (connectors) enable the constructions of ladder parts of different heights and widths. However, ladder parts can be made from other materials such as multiwall sheets, preferably using support parts.

Several examples of ladder parts are shown and described above with reference to element 16 (of FIGS. 19-22C), element 27 (of FIG. 32), element 31 (of FIGS. 39-41), and element 35 (of FIGS. 48-49). Ladder part (center frame) 16 is preferably made of multiwall polypropylene material. Ladder parts 27, 31 and 35 are made of plastic tubes 24, 29, and 32, and joints (connectors) 25, 28, 33. Center frame part 16 is an example of a ladder part made from multiwall polypropylene material.

The purpose of the ladder part is to carry the weight of the shelves (and the articles the store) to the floor. Preferably, the envelop part does not carry weight.

The envelop part provides the display system with stability, decorative value, and area for advertising the articles presented. The envelop part is preferably produced from light, flat and foldable material, preferably from plastic sheet, such as multiwall polypropylene board as described above. Easy folding of the envelop part is preferably provided using half-depth cuts through the multiwall structure as described above with reference to FIGS. 2A, 2B, 3A, and 3B. Since the ladder part has two legs it is inherently unstable. The envelope part provides stability by eliminating the titling of the ladder part by providing at least one more contact area with the floor. Preferably the contact area with the floor is large enough to eliminate excessive pressure on any part of the envelop part so that the envelop part, which is relatively thin and flexible, does not collapse.

Several examples of envelop parts are shown and described above with reference to FIG. 4, FIGS. 11A and 11B, element 12 (of FIGS. 18A, 18B and 22A-22C), element 20 (of FIG. 24), element 31 (of FIGS. 39-41), element 35 (of FIGS. 48-49) and elements 37 and 38 (of FIGS. 61-65C).

The envelop part is preferably constructed of a back base part (or back part) and two beam parts (or side parts). Preferably, the beam or side parts are attached to the ladder part with fasteners. Preferably, the back parts include slots to accommodate flap parts of the shelves.

Each of the shelf parts preferably rests on a horizontal part of the ladder part and is balanced by the envelop, preferably by inserting a flap part of the shelf into a slot provided in the back base part of the envelop. Preferably, the ladder part is positioned so that the horizontal part supports the shelf part at an optimal point to avoid collapsing of the shelf or envelop parts. Such optimal position may be at the middle of the shelf part. Several examples of shelf parts are shown and described above with reference to element 18 (of FIGS. 21-22C), and element 22 (of FIGS. 25, 40 and 49).

Several examples of joint (connector) parts are shown and described above with reference to element 25 (of FIGS. 30-32), element 28 (of FIGS. 30-39), and element 33 (of FIGS. 44A-48). Joint parts connect horizontal and vertical parts to form ladder parts. Joint parts preferably also provide for fasteners, preferably to fasten the envelop part to the ladder part.

Several examples of fastener parts are shown and described above with reference to element 26 (of FIGS. 30-33), element 30 (of FIGS. 36 and 42), and element 34 (of FIG. 45).

Examples of a support part are provided by the rod part of FIG. 8 as well as element 42 of FIG. 56. These support parts support a shelf part by conveying the weight to the envelop part.

Several examples of accessory parts such as a base part, a head part, etc. are shown and described above with reference to the elements of FIGS. 5-7, 9, 10, 14A and 14B, element 17 of FIG. 20, elements 39, 40, and 43-46 of FIGS. 53, 54 and 57-60, respectively as well as element 39 of FIGS. 61-64B.

Reference is now made to FIGS. 66A, 66B, 66C, 67, 68, 69A, 69B, 69B, 69C, and 69D, which are a simplified illustrations of a display system 48 according to a preferred embodiment of the present invention.

Figures 66A, 66B, 66C, 67, 68, 69A, 69B, 69C, 69D:
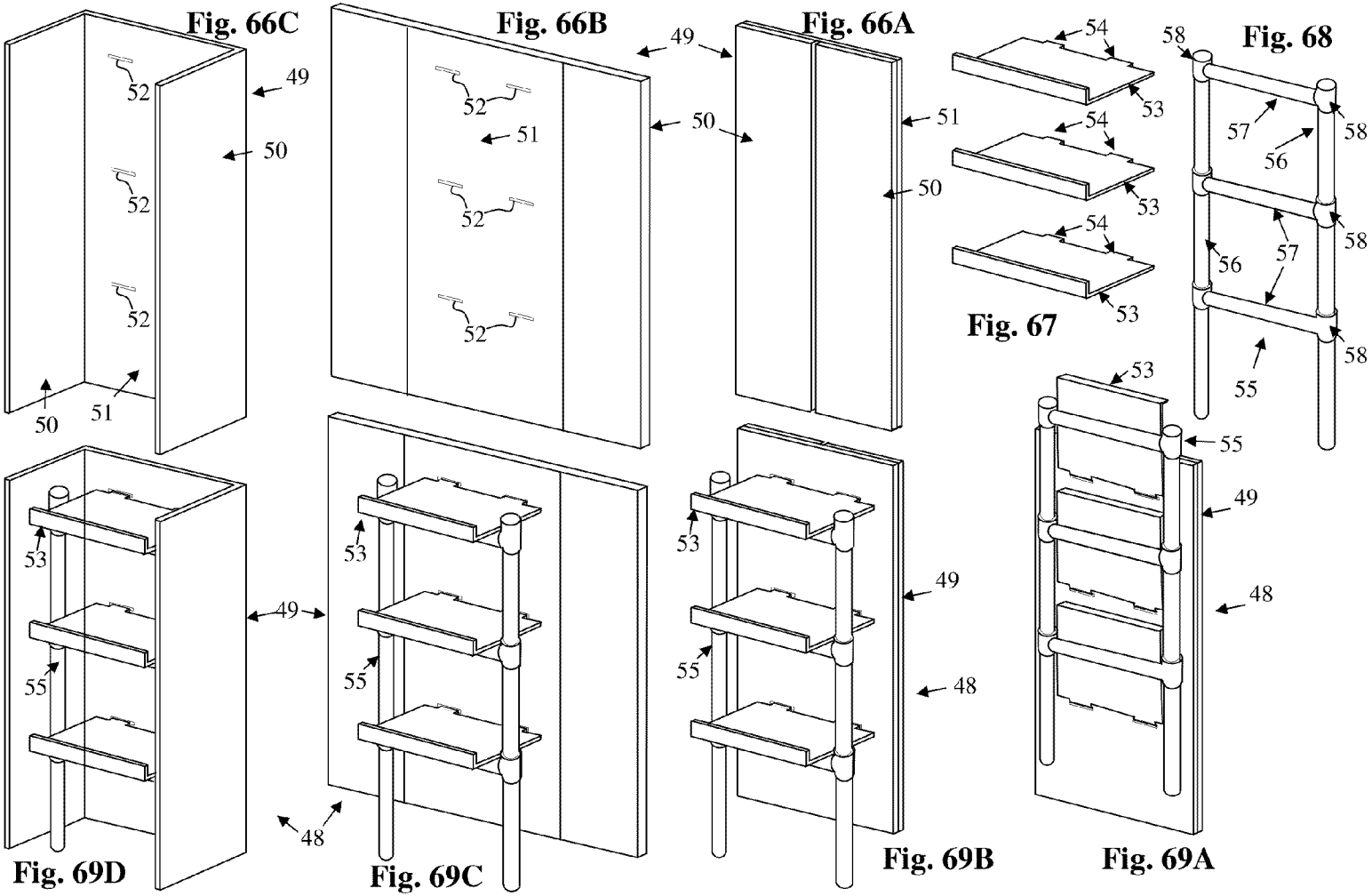
FIG. 66A is a simplified illustration of a back view of the envelope of the display system in the closed-back mode with the side panels folded behind the back panel.
FIG. 66B is a simplified illustration of a front view of the envelope in the flat-open mode with the side panels opened in-line with the back panel.
FIG. 66C is a simplified illustration of a front view of the envelope in the open (positioned) mode with the side panels at right-angles with the back panel (front-fold mode)
FIG. 67 is a simplified illustration of a shelves of the display system showing their flaps.
FIG. 68 is a simplified illustration of a ladder part of the display system showing vertical parts, horizontal pats and joints (connectors)
FIG. 69A is a simplified illustration of the display system assembled and folded to minimize volume.
FIG. 69B is a simplified illustration of the display system with the envelop in the fold-back mode and the ladder and shelves folded down to position the display system in place.
FIG. 69C is a simplified illustration of the display system with the envelop in the flat open mode and the ladder and shelves folded down.
FIG. 69D is a simplified illustration of the display system assembled and positioned in place with the envelop in the front-fold mode.

FIG. 66A shows a back view of the envelope 49 of the display system 48 in the closed-back mode with the side panels 50 folded behind the back panel 51.

FIG. 66B shows a front view of the envelope 49 in the flat-open mode with the side panels 50 opened in-line with the back panel 51. FIG. 66B also shows slots 52.

FIG. 66C shows a front view of the envelope 49 in the open (positioned) mode with the side panels 50 at right-angles with the back panel 51 (front-fold mode).

FIG. 67 shows a shelves 53 of the display system 50 with flaps 54.

FIG. 68 shows a ladder part 55 of the display system 50 with vertical parts 56, horizontal pats 57 and joints (connectors) 58.

FIG. 69A shows the display system 50 assembled with the envelope part 49, the shelves 53, and the ladder part 55, and folded closed in with the envelop in the fold-back mode and the ladder and shelves folded up to minimize the volume consumed by the display system 50. In this mode it is convenient and economical to store the display system 50 or to carry it around. It is appreciated that the ladder and shelves can also be folded down to preserve space and that the envelop can be in the flat-open mode.

FIG. 69B shows the display system 50 with the envelop in the fold-back mode and the ladder and shelves folded down to position the display system 50 in place.

FIG. 69C shows the display system 50 with the envelop in the flat open mode and the ladder and shelves folded down.

FIG. 69D shows the display system 50 assembled and positioned in place with the envelop in the front-fold mode and preferably connected to the ladder part with fasteners (not shown).

It is therefore appreciated that the display system 50 is preferably constructed in a manner that enables the side parts (beam parts) to fold back and forth with relation to the back part. The beam parts may be folded along the back part, or behind the back part, to provide a flat surface. This closed mode (configuration) preferably consumes minimal volume, is easy to carry around, to store and to stack, as shown in FIG. 69A. The beam parts may also be folded in right angle to the back part, or a similar angle. This open (positioned) mode (configuration) preferably enables the display system to be positioned vertically, that provides stability to the display system, and supports the shelves horizontally, as shown in FIG. 69D.

Furthermore, the display system 50 is preferably constructed in a manner that enables folding the system into the closed mode where the ladder part and the shelves folds upwards (as shown in FIG. 69A) or downwards, to reduce the volume consumed.

Figure 70A:
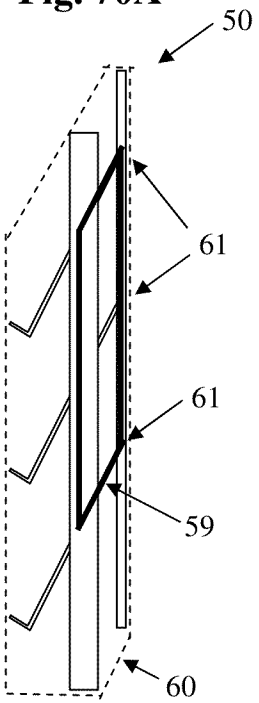
FIG. 70A is a simplified illustration of the display system in a fold-down mode.
Figure 70B:
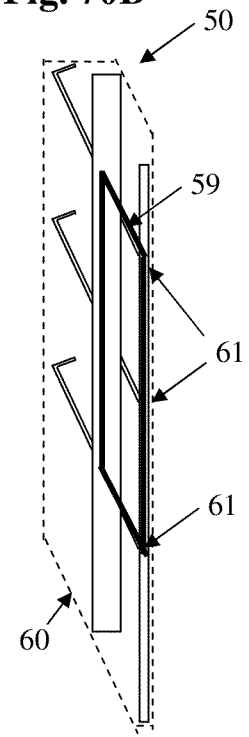
FIG. 70B is a simplified illustration of the display system in a fold-up mode.

Reference is now made to FIGS. 70A, 70B, and 70B, which are simplified illustration of side views of the display system 50 in different folding modes according to a preferred embodiment of the present invention.

FIG. 70A shows the display system 50 in a fold-down mode.

FIG. 70B shows the display system 50 in a fold-up mode.

Figure 70C:
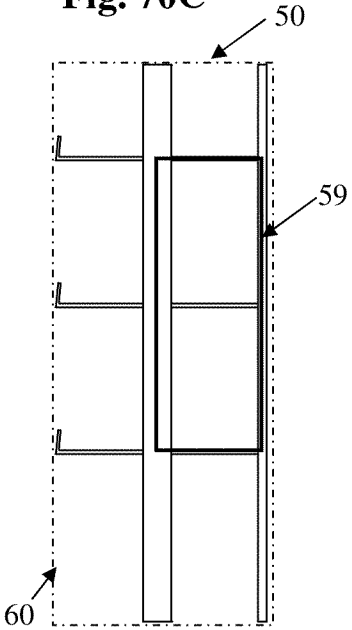
FIG. 70C is a simplified illustration of the display system in the open (positioned) mode.

FIG. 70C shows the display system 50 in the open (positioned) mode (but with the side removed for clarity).

FIG. 70A-70C show a virtual parallelogram 59, and a cut 60 of a virtual box representing the volume consumed by the display system 50 in each mode.

Thus the ladder part, the back part and the shelves form together parallelogram 59, which changes between the closed folding mode (for storing and carrying) and the open folding mode (for positioning) affecting the parallelogram's angles.

It is therefore appreciated that the shelves are coupled with the envelop part and with the ladder part to enable folding, and that the folding enables one folding mode (positioning mode) enabling placement of articles on the shelves and another folding mode (closed mode) consuming a volume smaller than the volume of said first folding mode. Preferably, the open folding mode separates between said back part and said ladder part and the closed folding mode bring the back part and the ladder part closer to preserve space.

Preferably, ladder part 55 is made of a rigid material and the envelop part 49, and optionally the shelves 53 too, are made of a light, thin and optionally flexible material such as multiwall structure of polypropylene material.

Optionally, the ladder part 55 includes a rigid vertical part 56, and a rigid horizontal part 57 made from a vertically flat material such as multiwall structure of polypropylene material. Therefore, the display system may include a ladder part, and/or an envelop part, and/or a shelve part made of a multiwall structure of polypropylene material or any other type of plastic sheet or plastic board.

As shown in FIGS. 66B, 67 and 69A to 69D the envelop part 49 preferably includes a plurality of slots 52, and the shelves 53 preferably includes flaps or tabs 54 that are insertable into the slots 52. As shown in FIGS. 69A and 69B, the flap 54 when inserted into a slot 52 provides an axle 61 about which the shelf 53 may be rotated relative to the envelop part 49 to enable upward and/or downward folding of the shelves as well as the entire display system 50 as further shown in FIGS. 70A and 70B.

As shown in FIGS. 30-33, 36, 42, and FIG. 45, the display system preferably includes at least one fastener part such as elements 26, 30, and 34 (respectively). The fastener parts are used for fastening the envelop part to the ladder part, preferably at the joints. Such fastener parts may have the shape of a rivet, a slotted spring pin, a bayonet type clamp, a magnet or a pair of magnets, etc.

As shown in FIGS. 66A-66C, the display system includes an envelop part 49 that includes a back part 51 and at least one side part 50 that is foldable with respect to the back part. Preferably, the envelop is made of a multiwall of polypropylene board or a similar material and a fold is provided between the back part and the side part where the fold is made of a half-depth cut though the multiwall structure. Thus, the fold enables folding the side part along the back part, and/or in parallel to the back part, and/or forming an angle with the back part.

As shown in FIG. 68, the display system is constructed with connector parts (joints) 58 that may connect two vertical parts, and/or a vertical part and a horizontal part, and/or a vertical part and an envelope part.

As shown in FIGS. 35A-38 and FIGS. 41-48, the display system is constructed with connector parts (joints) that can slide on the vertical part so that the horizontal parts, and/or the shelves, can be positioned flexibly and continuously. It is appreciated that such connector part may use a dovetail joint.

Figure 71:
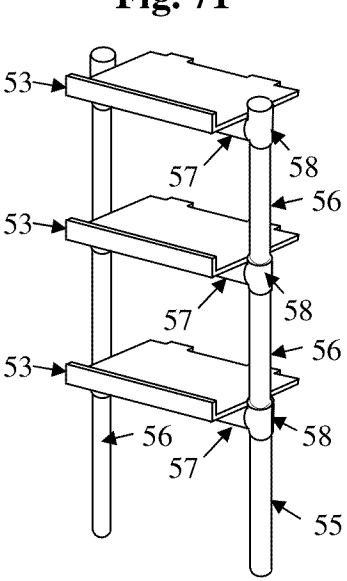
FIG. 71 is a simplified illustration of shelves positioned on a ladder.

Reference is now made to FIG. 71, which is a simplified illustration of a ladder and shelves according to a preferred embodiment of the present invention.

As shown in FIG. 71 as well as in FIGS. 69B-69C, the display system is constructed so that the shelves 53 are positioned over the ladder part 55 to transfer the weight of the article stored on the shelves to the horizontal parts 57 of the ladder part, and the horizontal parts are coupled to transfer the weight to the vertical parts 56, and the vertical parts are positioned to transfer the weight to the floor.

It is expected that during the life of this patent many relevant methods and systems will be developed and the scope of the terms herein, particularly of the terms "multiwall structure", "polypropylene material", "board", "sheet", "plate", and "plane", are intended to include all such new technologies a priori.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable sub-combination.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention.

What is claimed is:

1. An apparatus for storing an article for display, the apparatus comprising:

a ladder part comprising two vertical profiles and a plurality of horizontal profiles, said ladder part constructed to support weight;

an envelop part comprising a back part and side parts on either side of said back part, said envelop part constructed to provide stability; and a plurality of shelves constructed for placing articles, said shelves coupled with said envelop part and with said ladder part to enable folding of said apparatus while constructed, such that said shelves are coupled with said ladder part and with said envelop part;

wherein said folding enables a first folding mode enabling placement of articles on said shelves and a second folding mode wherein said apparatus consumes a volume smaller than a volume of said first folding mode, and wherein each of said two vertical profiles comprises a plurality of separable vertical profile segments and a plurality of connector parts, each connector part separably connecting at least two of:

two of said vertical profile segments;

one of said vertical profile segments and one of said horizontal profiles; and one of said vertical profile segments and said envelope part, wherein each one of said shelves comprises a pair of flaps extending from distal sides of said shelves facing said back part, said back part comprising a plurality of pairs of slots, each pair of slots configured to receive and lock a pair of said flaps, wherein said ladder part is positioned in a middle of a space enclosed by said envelope part, wherein each one of said plurality of horizontal profiles of said ladder part is configured to support one of said plurality of shelves in a center and provide an axle about which said shelves are rotatable relative to said back part and ladder part between a horizontal position in said first folding mode, wherein an entire top surface of said shelves is fully accessible for placing articles, and a vertical position in said second folding mode, with the top or a bottom surface of said shelves facing said back part.

2. The apparatus according to claim 1, wherein said ladder part, said back part and said shelves form a parallelogram and wherein said folding affects the parallelogram's angles.

3. The apparatus according to claim 2, wherein said first folding mode separates between said back part and said ladder part and wherein said second folding mode brings said back part and said ladder part closer.

4. The apparatus according to claim 1, wherein said ladder part comprises rigid material, and wherein said envelop part comprises a flexible material.

5. The apparatus according to claim 1, wherein at least one of said ladder part, said envelop part, and said shelves comprises a multiwall structure of polypropylene material.

6. The apparatus according to claim 1, wherein at least one of said envelop part, and said shelves comprises a plastic sheet.

7. The apparatus according to claim 1, wherein at least one of said side part is foldable with respect to said back part at least one of: along said back part, in parallel to said back part, and forming an angle with said back part.

8. The apparatus according to claim 7, wherein said envelop part comprises a fold between said back part and one of said side parts and wherein said fold comprises a half-depth cut.

9. The apparatus according to claim 1, wherein said shelves are constructed to transfer weight of said article to said horizontal part and wherein said horizontal part is constructed to transfer said weight to said vertical part and wherein said vertical part is constructed to transfer said weight to a floor.

10. The apparatus according to claim 1, wherein, when said apparatus is unfolded, said side parts are configured to be fastened to said ladder part to prevent folding of said apparatus.

* * * * *